US011594351B2

(12) United States Patent
Kagaya et al.

(10) Patent No.: US 11,594,351 B2
(45) Date of Patent: Feb. 28, 2023

(54) MULTILAYER CHIP VARISTOR

(71) Applicant: TDK CORPORATION, Tokyo (JP)

(72) Inventors: Shin Kagaya, Tokyo (JP); Masayuki Uchida, Tokyo (JP); Naoyoshi Yoshida, Tokyo (JP); Takeshi Yanata, Tokyo (JP); Satoshi Goto, Tokyo (JP); Takeshi Oyanagi, Tokyo (JP); Yusuke Imai, Tokyo (JP); Daiki Suzuki, Tokyo (JP); Kaname Ueda, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 17/533,920

(22) Filed: Nov. 23, 2021

(65) Prior Publication Data

US 2022/0165460 A1 May 26, 2022

(30) Foreign Application Priority Data

Nov. 26, 2020 (JP) ..... JP2020-196245

(51) Int. Cl.
*H01C 7/18* (2006.01)
*H01C 7/112* (2006.01)
*H01C 7/10* (2006.01)

(52) U.S. Cl.
CPC ..... *H01C 7/18* (2013.01); *H01C 7/1006* (2013.01); *H01C 7/112* (2013.01)

(58) Field of Classification Search
CPC ..... H01C 7/1006; H01C 7/102; H01C 7/12; H01C 7/112
See application file for complete search history.

(56) References Cited

U.S. PATENT DOCUMENTS 4,290,041 A * 9/1981 Utsumi ..... H01C 7/102 338/21
5,075,665 A * 12/1991 Taira ..... H01C 1/14 338/273
5,119,062 A * 6/1992 Nakamura ..... H01C 7/10 338/21

(Continued)

FOREIGN PATENT DOCUMENTS

JP 2002-075774 A 3/2002
JP 2007-013215 A 1/2007

(Continued)

*Primary Examiner* — Kyung S Lee
(74) *Attorney, Agent, or Firm* — Oliff PLC

(57) ABSTRACT

A multilayer chip varistor includes an element body, first and second external electrodes, and first and second electrical conductor groups. The first electrical conductor group includes a first internal electrode connected to the first external electrode, and a first intermediate electrical conductor opposed to the first internal electrode. The second electrical conductor group includes a second internal electrode including a first electrically conductive material and connected to the second external electrode, and a second intermediate electrical conductor opposed to the second internal electrode. At least one of the first and second intermediate electrical conductors includes the second electrically conductive material. The element body includes a low electrical resistance region between the first and second internal electrodes. The second electrically conductive material is diffused in the low electrical resistance region.

6 Claims, 12 Drawing Sheets

(56) References Cited

U.S. PATENT DOCUMENTS

| | | | | |
|---|---|---|---|---|
| 5,324,986 | A * | 6/1994 | Ueno | H01C 7/10 257/702 |
| 6,147,587 | A * | 11/2000 | Hadano | H01C 7/10 338/21 |
| 6,184,769 | B1 * | 2/2001 | Nakamura | H01C 17/06546 338/21 |
| 2006/0220780 | A1 * | 10/2006 | Matsuoka | H01C 7/112 338/21 |
| 2016/0240311 | A1 | 8/2016 | Lee et al. | |

FOREIGN PATENT DOCUMENTS

| | | | |
|---|---|---|---|
| JP | 2016-149555 | A | 8/2016 |
| WO | 2019/173186 | A1 | 9/2019 |

* cited by examiner

*Fig.5*

| | NUMBER OF INTERMEDIATE CONDUCTORS | DISTANCE BETWEEN END EDGES [μm] | RATIO OF OPPOSING AREA | Al CONTENT OF INTERNAL ELECTRODE [atm%] | Al CONTENT OF INTERMEDIATE CONDUCTOR [atm%] | ESD TOLERANCE [kV] | ENERGY RESISTANCE [J] | LEAKAGE CURRENT [nA] | DYNAMIC RESISTANCE [Ω] | EVALUA-TION |
|---|---|---|---|---|---|---|---|---|---|---|
| EXAMPLE 1 | 2 | 0 | 1.0 | 0 | 0.1 | 22 | 0.06 | 108.4 | 1.90 | A |
| EXAMPLE 2 | 2 | 0 | 1.0 | 0 | 0.5 | 30 | 0.06 | 198.4 | 1.87 | A |
| EXAMPLE 3 | 2 | 0 | 1.0 | 0 | 1 | 30 | 0.06 | 288.2 | 1.85 | A |
| EXAMPLE 4 | 2 | 0 | 1.0 | 0 | 3 | 24 | 0.05 | 562.7 | 1.77 | A |
| EXAMPLE 5 | 2 | 0 | 1.0 | 0 | 5 | 22 | 0.03 | 782.9 | 1.71 | A |
| EXAMPLE 6 | 2 | 0 | 1.0 | 0.5 | 1 | 26 | 0.05 | 651.3 | 1.85 | A |
| EXAMPLE 7 | 2 | 0 | 1.0 | 0.5 | 0.5 | 22 | 0.04 | 714.8 | 1.81 | A |
| EXAMPLE 8 | 2 | 40 | 0.74 | 0 | 0.5 | 28 | 0.06 | 230.8 | 1.93 | A |
| EXAMPLE 9 | 2 | 80 | 0.5 | 0 | 0.5 | 24 | 0.04 | 212.5 | 1.96 | A |

*Fig.6*

| | NUMBER OF INTERMEDIATE CONDUCTORS | DISTANCE BETWEEN END EDGES [μm] | RATIO OF OPPOSING AREA | Al CONTENT OF INTERNAL ELECTRODE [atm%] | Al CONTENT OF INTERMEDIATE CONDUCTOR [atm%] | ESD TOLERANCE [kV] | ENERGY RESISTANCE [J] | LEAKAGE CURRENT [nA] | DYNAMIC RESISTANCE [Ω] | EVALUATION |
|---|---|---|---|---|---|---|---|---|---|---|
| COMPARATIVE EXAMPLE 1 | 1 | 0 | 1.0 | 0 | 0.5 | 30 | 0.06 | 11.0 | 2.24 | B |
| COMPARATIVE EXAMPLE 2 | 3 | 0 | 1.0 | 0 | 0.5 | 30 | 0.06 | 1200.0 | 1.87 | B |
| COMPARATIVE EXAMPLE 3 | 4 | 0 | 1.0 | 0 | 0.5 | 30 | 0.06 | 4532.6 | 1.81 | B |
| COMPARATIVE EXAMPLE 4 | 2 | 40 | 0.74 | 0 | 0 | 10 | 0.01 | 193.0 | 2.46 | B |
| COMPARATIVE EXAMPLE 5 | 2 | 80 | 0.5 | 0 | 0 | 8 | 0 | 181.2 | 2.35 | B |
| COMPARATIVE EXAMPLE 6 | 2 | 90 | 0.45 | 0 | 0 | 6 | 0 | 180.0 | 2.31 | B |
| COMPARATIVE EXAMPLE 7 | 2 | −20 | 1.1 | 0 | 0 | 10 | 0.01 | 202.6 | 2.19 | B |
| COMPARATIVE EXAMPLE 8 | 2 | −40 | 1.3 | 0 | 0 | 8 | 0 | 218.3 | 2.04 | B |
| COMPARATIVE EXAMPLE 9 | 2 | 90 | 0.45 | 0 | 0.5 | 18 | 0.02 | 151.8 | 1.95 | B |
| COMPARATIVE EXAMPLE 10 | 2 | −20 | 1.1 | 0 | 0.5 | 10 | 0.01 | 1926.9 | 1.85 | B |
| COMPARATIVE EXAMPLE 11 | 2 | −40 | 1.3 | 0 | 0.5 | 8 | 0 | 2538.6 | 1.71 | B |

*Fig.11*

| | NUMBER OF INTERMEDIATE CONDUCTORS | RELATIVE LENGTH [μm] | RATIO OF OPPOSING AREA | Al CONTENT OF INTERNAL ELECTRODE [atm%] | Al CONTENT OF INTERMEDIATE CONDUCTOR [atm%] | ESD TOLERANCE [kV] | ENERGY RESISTANCE [J] | LEAKAGE CURRENT [nA] | DYNAMIC RESISTANCE [Ω] | EVALUA-TION |
|---|---|---|---|---|---|---|---|---|---|---|
| REFERENCE EXAMPLE 1 | 2 | 0 | 0.17 | 0 | 0.1 | 22 | 0.06 | 2.4 | 1.98 | A |
| REFERENCE EXAMPLE 2 | 2 | 0 | 0.17 | 0 | 0.5 | 30 | 0.06 | 2.9 | 1.93 | A |
| REFERENCE EXAMPLE 3 | 2 | 0 | 0.17 | 0 | 1 | 30 | 0.06 | 5.6 | 1.89 | A |
| REFERENCE EXAMPLE 4 | 2 | 0 | 0.17 | 0 | 3 | 24 | 0.05 | 14.8 | 1.84 | A |
| REFERENCE EXAMPLE 5 | 2 | 0 | 0.17 | 0 | 5 | 22 | 0.03 | 20.1 | 1.81 | A |
| REFERENCE EXAMPLE 6 | 3 | 0 | 0.17 | 0 | 0.1 | 22 | 0.06 | 3.2 | 1.92 | A |
| REFERENCE EXAMPLE 7 | 3 | 0 | 0.17 | 0 | 0.5 | 30 | 0.06 | 3.4 | 1.88 | A |
| REFERENCE EXAMPLE 8 | 3 | 0 | 0.17 | 0 | 1 | 30 | 0.06 | 7.5 | 1.85 | A |
| REFERENCE EXAMPLE 9 | 3 | 0 | 0.17 | 0 | 3 | 24 | 0.05 | 19.4 | 1.83 | A |
| REFERENCE EXAMPLE 10 | 3 | 0 | 0.17 | 0 | 5 | 22 | 0.03 | 24.9 | 1.79 | A |
| REFERENCE EXAMPLE 11 | 2 | 41 | 0.10 | 0 | 0.5 | 28 | 0.04 | 2.9 | 1.95 | A |
| REFERENCE EXAMPLE 12 | 3 | 41 | 0.10 | 0 | 0.5 | 28 | 0.05 | 3.4 | 1.90 | A |
| REFERENCE EXAMPLE 13 | 2 | 0 | 0.17 | 0.5 | 1 | 26 | 0.05 | 26.8 | 1.95 | A |
| REFERENCE EXAMPLE 14 | 2 | 0 | 0.17 | 0.5 | 0.5 | 22 | 0.04 | 15.2 | 1.93 | A |
| REFERENCE EXAMPLE 15 | 3 | 0 | 0.17 | 0.5 | 1 | 26 | 0.05 | 26.8 | 1.85 | A |
| REFERENCE EXAMPLE 16 | 3 | 0 | 0.17 | 0.5 | 0.5 | 22 | 0.04 | 15.2 | 1.82 | A |

*Fig.12*

| | NUMBER OF INTERMEDIATE CONDUCTORS | RELATIVE LENGTH [μm] | RATIO OF OPPOSING AREA | Al CONTENT OF INTERNAL ELECTRODE [atm%] | Al CONTENT OF INTERMEDIATE CONDUCTOR [atm%] | ESD TOLERANCE [kV] | ENERGY RESISTANCE [J] | LEAKAGE CURRENT [nA] | DYNAMIC RESISTANCE [Ω] | EVALUA-TION |
|---|---|---|---|---|---|---|---|---|---|---|
| REFERENCE EXAMPLE 17 | 1 | 0 | 0.17 | 0 | 0.5 | 30 | 0.06 | 2.6 | 2.24 | B |
| REFERENCE EXAMPLE 18 | 2 | −22 | 0.20 | 0 | 0 | 10 | 0.01 | 9.8 | 2.24 | B |
| REFERENCE EXAMPLE 19 | 2 | 0 | 0.17 | 0 | 0 | 8 | 0 | 2.5 | 2.49 | B |
| REFERENCE EXAMPLE 20 | 2 | 41 | 0.10 | 0 | 0 | 6 | 0 | 2.0 | 2.57 | B |
| REFERENCE EXAMPLE 21 | 2 | −22 | 0.20 | 0 | 0.5 | 18 | 0.01 | 18.2 | 1.89 | B |
| REFERENCE EXAMPLE 22 | 2 | 73 | 0.05 | 0 | 0.5 | 10 | 0.01 | 2.0 | 2.10 | B |
| REFERENCE EXAMPLE 23 | 3 | −22 | 0.20 | 0 | 0 | 12 | 0.01 | 11.8 | 2.58 | B |
| REFERENCE EXAMPLE 24 | 3 | 0 | 0.17 | 0 | 0 | 8 | 0 | 3.0 | 2.27 | B |
| REFERENCE EXAMPLE 25 | 3 | 41 | 0.10 | 0 | 0 | 6 | 0 | 2.7 | 2.31 | B |
| REFERENCE EXAMPLE 26 | 3 | −22 | 0.20 | 0 | 0.5 | 18 | 0.01 | 22.2 | 1.85 | B |
| REFERENCE EXAMPLE 27 | 3 | 73 | 0.05 | 0 | 0.5 | 12 | 0.01 | 2.9 | 2.05 | B |

MULTILAYER CHIP VARISTOR

BACKGROUND OF THE INVENTION

Field of the Invention

One aspect of the present invention relates to a multilayer chip varistor.

Description of Related Art

Known multilayer chip varistors include an element body exhibiting varistor characteristics, first and second internal electrodes disposed in the element body to be opposed to each other, and first and second external electrodes disposed on the element body (see, for example, Japanese Unexamined Patent Publication No. 2007-13215). The first internal electrode is connected to the first external electrode. The second internal electrode is connected to the second external electrode.

SUMMARY OF THE INVENTION

Multilayer chip varistors are required to have an improved tolerance to electro static discharge (ESD). Hereinafter, the tolerance to ESD is referred to as an "ESD tolerance". A multilayer chip varistor with an improved ESD tolerance is used as an effective protection element for an electronic circuit, and for example, stably operates a high-speed communication network system based on the recent Ethernet (registered trademark) standard.

An object of one aspect of the present invention is to provide a multilayer chip varistor with an improved ESD tolerance.

A multilayer chip varistor according to one aspect includes: an element body exhibiting varistor characteristics; a first external electrode and a second external electrode disposed at both ends of the element body; and a first electrical conductor group and a second electrical conductor group disposed in the element body. The first electrical conductor group includes: a first internal electrode including a first electrically conductive material, the first internal electrode being exposed at one end of the ends and connected to the first external electrode; and a first intermediate electrical conductor opposed to the first internal electrode and not connected to the first and second external electrodes. The second electrical conductor group includes: a second internal electrode including the first electrically conductive material, the second internal electrode being exposed at another end of the ends and connected to the second external electrode; and a second intermediate electrical conductor opposed to the second internal electrode and not connected to the first and second external electrodes. The first and second electrical conductor groups are disposed in the element body such that the first intermediate electrical conductor and the second intermediate electrical conductor are opposed to each other in a direction where the first internal electrode and the first intermediate electrical conductor are opposed to each other and in a direction where the second internal electrode and the second intermediate electrical conductor are opposed to each other. At least one of the first and second intermediate electrical conductors includes a second electrically conductive material different from the first electrically conductive material. The element body includes a low electrical resistance region between the first and second internal electrodes, and the second electrically conductive material included in the at least one of the first and second intermediate electrical conductors is diffused in the low electrical resistance region.

According to the one aspect, the element body includes the region in which the second electrically conductive material included in the at least one of the first and second intermediate electrical conductors is diffused between the first and second internal electrodes. The region in which the second electrically conductive material is diffused has a lower electrical resistance than the region in which the second electrically conductive material is not diffused. The multilayer chip varistor has an improved ESD tolerance.

The multilayer chip varistor according to the one aspect may include: a first internal electrical conductor disposed in the same layer as at least one intermediate electrical conductor of the first and second intermediate electrical conductors, the first internal electrical conductor being separated from the at least one intermediate electrical conductor, exposed at the one end, and connected to the first external electrode; and a second internal electrical conductor disposed in the same layer as at least one intermediate electrical conductor of the first and second intermediate electrical conductors, the second internal electrical conductor being separated from the at least one intermediate electrical conductor, exposed at the other end, and connected to the second external electrode.

In the configuration in which the first and second internal electrical conductors are in the same layer as the intermediate electrical conductor, are disposed at positions separated from the intermediate electrical conductor, and are exposed at the ends of the element body, the first internal electrical conductor identifies that at least one intermediate electrical conductor of the first and second intermediate electrical conductors is surely disposed in the same layer as the first internal electrical conductor. The second internal electrical conductor identifies that at least one intermediate electrical conductor of the first and second intermediate electrical conductors is surely disposed in the same layer as the second internal electrical conductor.

In the one aspect, the first and second internal electrodes include the second electrically conductive material.

In the configuration in which the first and second internal electrodes include the second electrically conductive material, the second electrically conductive material is diffused from the first and second internal electrodes to the region between the first and second internal electrodes. This configuration surely has the improved ESD tolerance.

In the one aspect, a content of the second electrically conductive material in the at least one intermediate electrical conductor of the first and second intermediate electrical conductors may be equal to or larger than a content of the second electrically conductive material in each of the first and second internal electrodes.

In the configuration in which the content of the second electrically conductive material is equal to or larger than the content of the second electrically conductive material in each of the first and second internal electrodes, the second electrically conductive material is more surely diffused from the at least one of the first and second intermediate electrical conductors to the region between the first and second internal electrodes. Therefore, this configuration surely has the more improved ESD tolerance.

In the one aspect, the first and second intermediate electrical conductors may include the second electrically conductive material.

In the configuration in which the first and second intermediate electrical conductors includes the second electrically conductive material, the second electrically conductive material is diffused from the first and second intermediate electrical conductors to the region between the first and second internal electrodes, and the electrical resistance is more surely reduced. Therefore, this configuration surely has the more improved ESD tolerance.

In the above one aspect, the first electrically conductive material may include palladium, and the second electrically conductive material may include aluminum.

The present invention will become more fully understood from the detailed description given hereinafter and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 5 is a table illustrating test results in Examples of the multilayer chip varistor according to the present embodiment;

FIG. 6 is a table illustrating test results in Comparative Examples of the multilayer chip varistor according to the present embodiment;

FIG. 11 is a table illustrating test results in Reference Examples of the multilayer chip varistor according to the present supplementary notes; and FIG. 12 is a table illustrating test results in Reference Examples of the multilayer chip varistor according to the present supplementary notes.

DETAILED DESCRIPTION OF EMBODIMENTS

Figure 1:
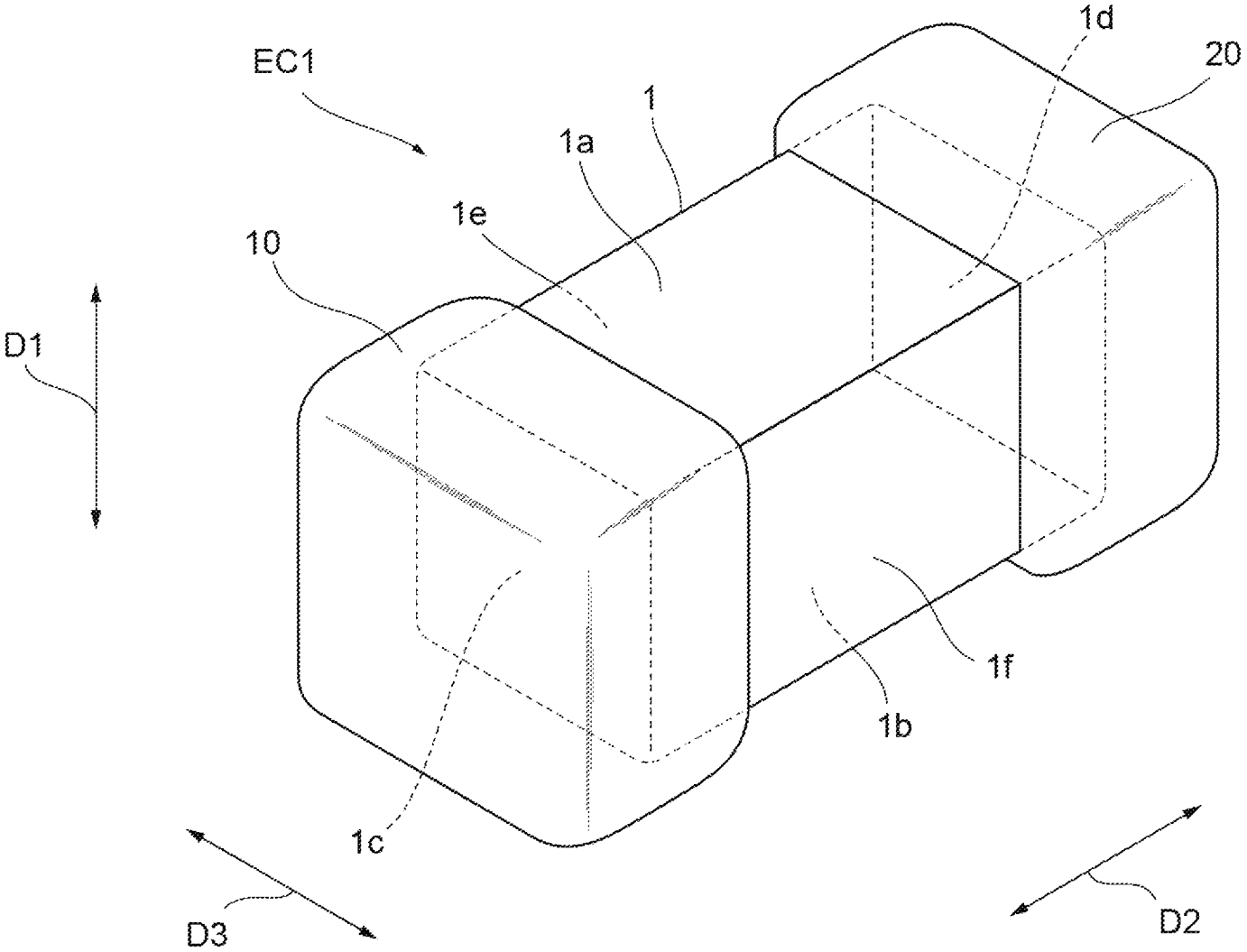
FIG. 1 is a perspective view illustrating a multilayer chip varistor according to an embodiment.

Hereinafter, embodiments of the present invention will be described in detail with reference to the accompanying drawings. In the following description, the same elements or elements having the same functions are denoted with the same reference numerals and overlapped explanation is omitted.

Figure 2:
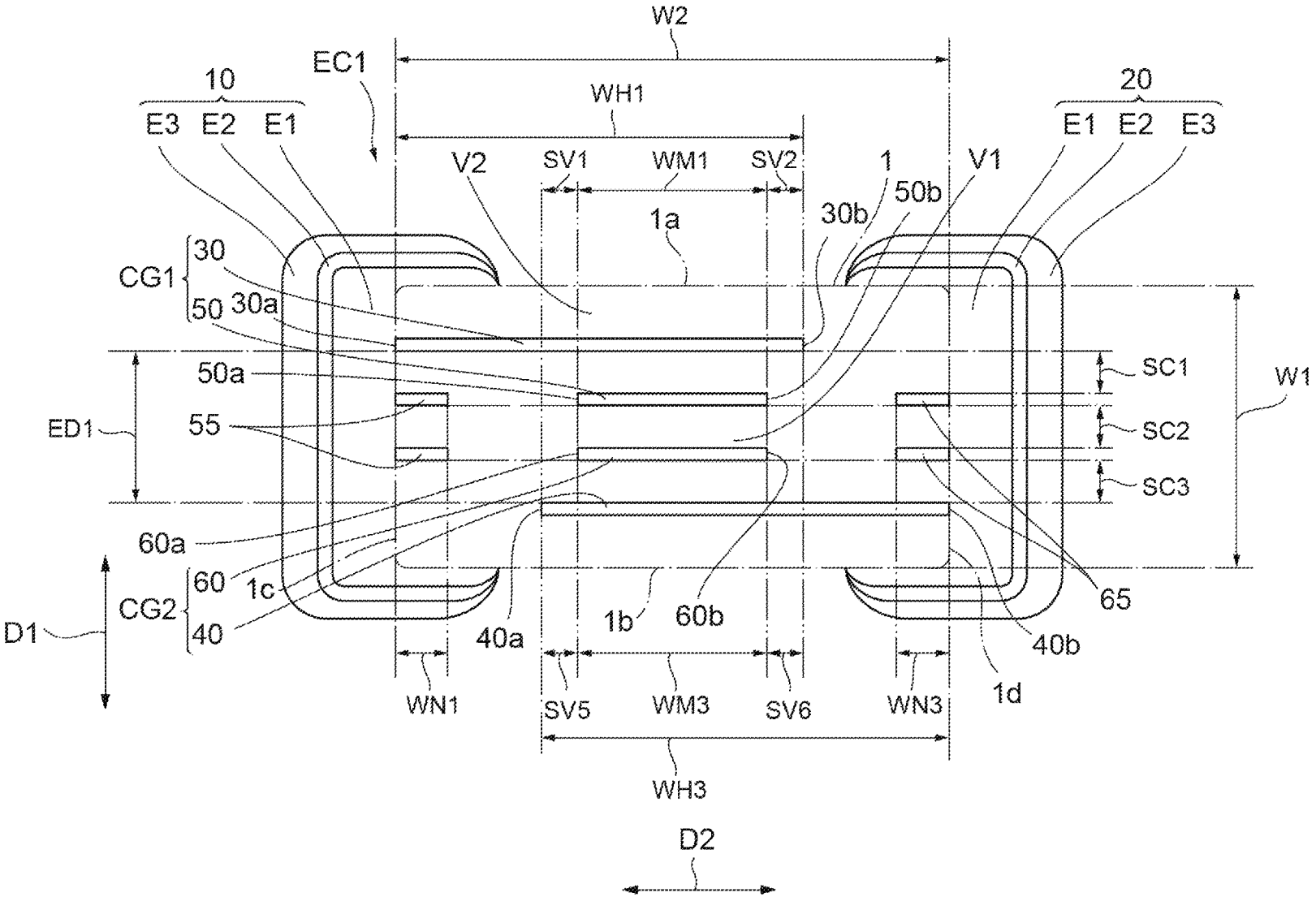
FIG. 2 is a schematic view illustrating a cross-sectional configuration of the multilayer chip varistor according to the present embodiment.
Figure 3:
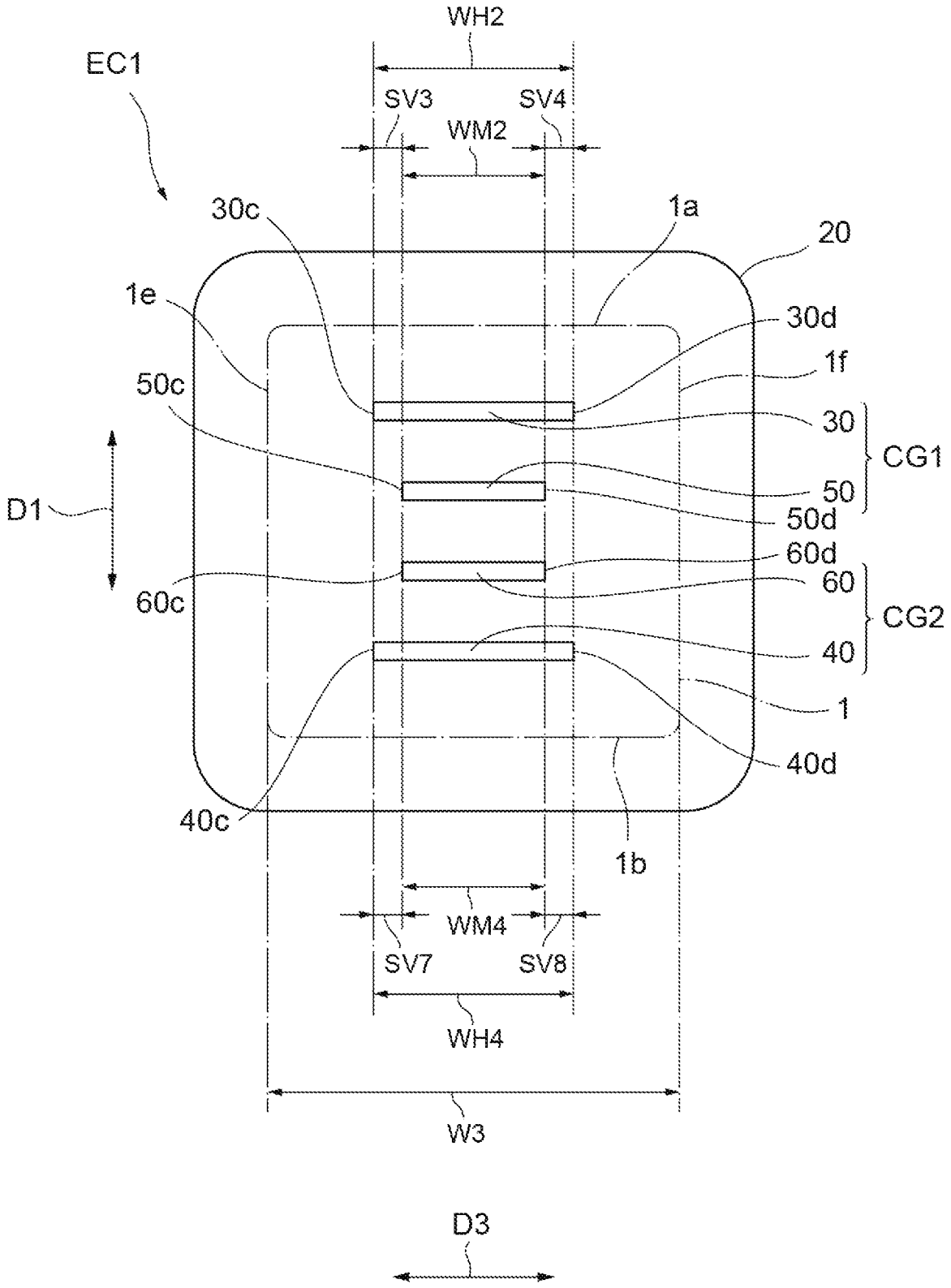
FIG. 3 is a schematic view illustrating a cross-sectional configuration of the multilayer chip varistor according to the present embodiment.
Figure 4:
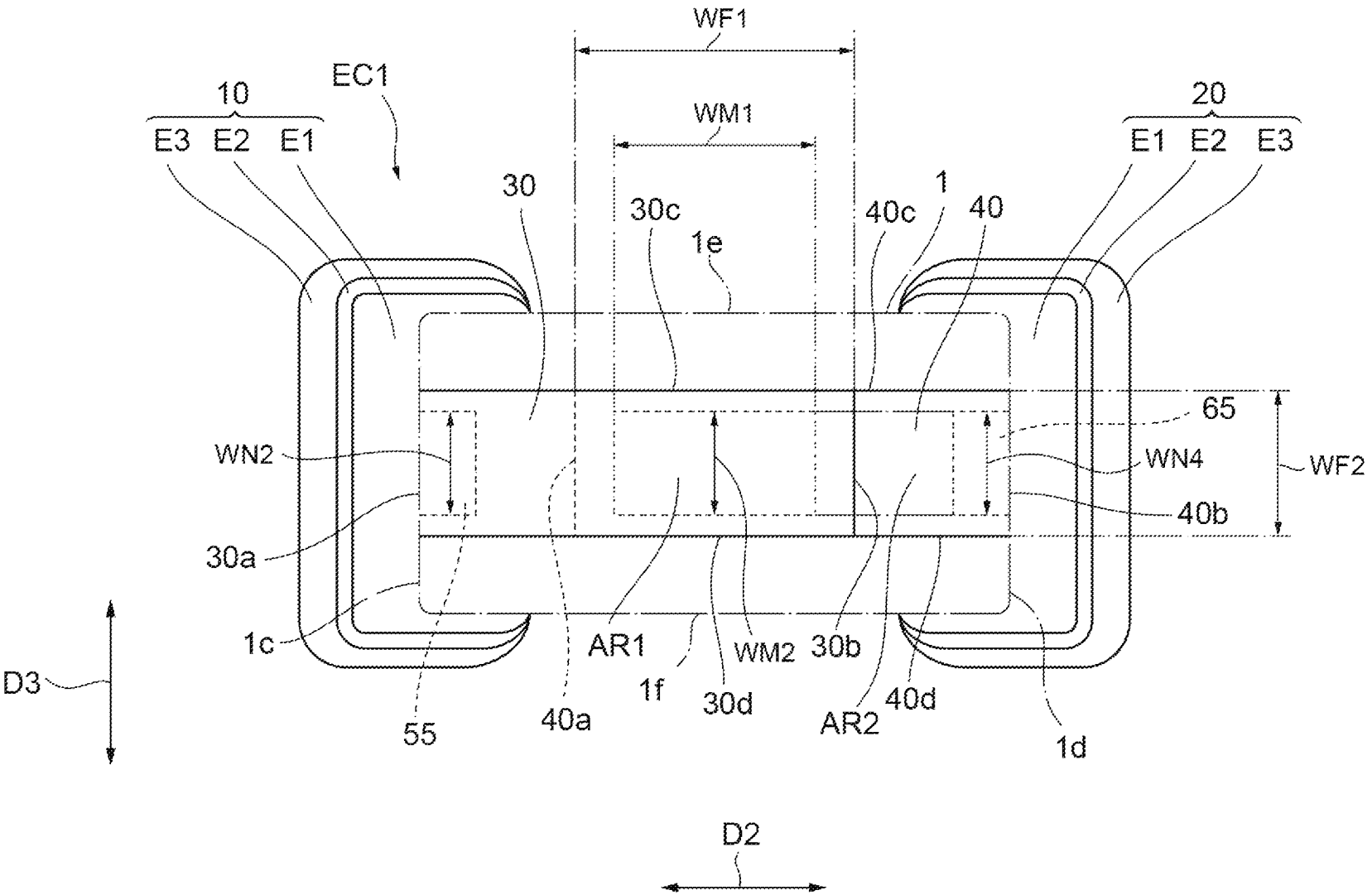
FIG. 4 is a schematic view illustrating a cross-sectional configuration of the multilayer chip varistor according to the present embodiment.

A configuration of a multilayer chip varistor EC1 according to an embodiment will be described with reference to FIGS. 1 to 4. FIG. 1 is a perspective view illustrating a multilayer chip varistor according to an embodiment. FIG. 2 is a schematic view illustrating a cross-sectional configuration of the multilayer chip varistor according to the present embodiment. FIG. 3 is a schematic view illustrating a cross-sectional configuration of the multilayer chip varistor according to the present embodiment. FIG. 4 is a schematic view illustrating a cross-sectional configuration of the multilayer chip varistor according to the present embodiment.

As illustrated in FIGS. 1 to 4, the multilayer chip varistor EC1 includes an element body 1, first and second external electrodes 10 and 20 disposed on an outer surface of the element body 1, and first and second electrical conductor groups CG1 and CG2 disposed in the element body 1. The element body 1 exhibits varistor characteristics (voltage non-linear characteristics).

The element body 1 includes semiconductor ceramic. The element body 1 is a ceramic element body formed by laminating a plurality of varistor layers composed of semiconductor ceramics. The plurality of varistor layers are actually integrated to the extent that their boundaries cannot be seen. In the present embodiment, the plurality of varistor layers are multilayered in a first direction D1, for example.

The element body 1 has a rectangular parallelepiped shape. The element body 1 includes a pair of principal surfaces 1*a* and 1*b* opposed to each other, a pair of end surfaces 1*c* and 1*d* opposed to each other, and a pair of side surfaces 1*e* and 1*f* opposed to each other. The principal surfaces 1*a* and 1*b*, the end surfaces 1*c* and 1*d*, and the side surfaces 1*e* and 1*f* constitute an outer surface of the element body 1. The principal surfaces 1*a* and 1*b* are opposed to each other in the first direction D1. The end surfaces 1*c* and 1*d* are opposed to each other in a second direction D2 intersecting the first direction D1. The side surfaces 1*e* and 1*f* are opposed to each other in a third direction D3 intersecting the first direction D1 and the second direction D2. In the present embodiment, the first direction D1, the second direction D2, and the third direction D3 are orthogonal to each other. The second direction D2 is, for example, a longitudinal direction of the rectangular parallelepiped shape of the element body 1. The term "rectangular parallelepiped shape" as used herein includes a rectangular parallelepiped shape whose corners and ridges are chamfered, and a rectangular parallelepiped whose corners and ridges are rounded.

The end surface 1*c* and the end surface 1*d* extend in the first direction D1 to couple the principal surface 1*a* and the principal surface 1*b*. The side surface 1*e* and the side surface 1*f* extend in the first direction D1 to couple the principal surface 1*a* and the principal surface 1*b*. The principal surface 1*a* and the principal surface 1*b* extend in the second direction D2 to couple the end surface 1*c* and the end surface 1*d*. The side surface 1*e* and the side surface 1*f* extend in the second direction D2 to couple the end surface 1*c* and the end surface 1*d*. The principal surface 1*a* and the principal surface 1*b* extend in the third direction D3 to couple the side surface 1*e* and the side surface 1*f*. The end surface 1*c* and the end surface 1*d* extend in the third direction D3 to couple the side surface 1*e* and the side surface 1*f*.

In the present embodiment, a length W1 of the element body 1 in the first direction D1 is about 0.5 mm, a length W2 of the element body 1 in the second direction D2 is about 1.0 mm, and a length W3 of the element body 1 in the third direction D3 is about 0.5 mm. The multilayer chip varistor EC1 is a so-called 1005 type chip varistor. The multilayer chip varistor EC1 is not limited to the size of the 1005 type. The multilayer chip varistor EC1 may have a so-called 1608 size (1.6 mm×0.8 mm×0.8 mm).

The varistor layer includes, for example, zinc oxide (ZnO). ZnO is a main component of the varistor layer. The varistor layer includes, for example, an elemental metal and an oxide thereof. The elemental metal and the oxide thereof are accessory constituents of the varistor layer. The elemental metal included in the varistor layer includes, for example, Co, a rare earth metal element, a group IIIb element, Si, Cr, Mo, an alkali metal element, or an alkaline earth metal element. The group IIIb element includes, for example, B, Al, Ga, or In. The alkali metal element includes, for example, K, Rb, or Cs. The alkaline earth metal element includes, for example, Mg, Ca, Sr, or Ba. In the present embodiment, the accessory constituents of the varistor layer include, for example, Co, Pr, Cr, Ca, K, Si, and Al.

As illustrated in FIG. 2, the first and second external electrodes 10 and 20 are disposed at both ends of the element body 1. The first external electrode 10 is disposed at one end of the element body 1. The second external electrode 20 is disposed at another end of the element body 1. In the present embodiment, the first external electrode 10 is disposed on the end surface 1*c*. The second external electrode 20 is disposed on the end surface 1*d*. The first and second external electrodes 10 and 20 are opposed to each other in the second direction D2.

The first and second external electrodes 10 and 20 each include an electrode layer E1, a first plating layer E2, and a second plating layer E3. The electrode layer E1 is formed on the outer surface of the element body 1. The electrode layer E1 is disposed to cover a corresponding one of the pair of end surfaces 1*c* and 1*d*. As illustrated in FIG. 1, the electrode layer E1 is disposed on a part of each of the pair of principal surfaces 1*a* and 1*b* and on a part of each of the pair of side surfaces 1*e* and 1*f*. The electrode layer E1 is, for example, a sintered electrode layer. The electrode layer E1 is formed due to sintering a conductive paste applied to the outer surface of the element body 1. The conductive paste includes, for example, a metal powder, a glass component, an alkali metal, an organic binder, and an organic solvent. The metal powder includes, for example, Ag particles or Ag—Pd alloy particles.

The first plating layer E2 covers the electrode layer E1. The first plating layer E2 is formed through a plating method. The first plating layer E2 is, for example, a Ni plating layer, a Sn plating layer, a Cu plating layer, or an Au plating layer. The second plating layer E3 covers the first plating layer E2. The second plating layer E3 constitutes the outermost layers of the first and second external electrodes 10 and 20. The second plating layer E2 is formed through, for example, the plating method. The second plating layer E3 is, for example, a Sn plating layer, a Sn—Ag alloy plating layer, a Sn—Bi alloy plating layer, or a Sn—Cu alloy plating layer.

The first and second electrical conductor groups CG1 and CG2 will be described. The first electrical conductor group CG1 includes a first internal electrode 30 and a first intermediate electrical conductor 50. The second electrical conductor group CG2 includes a second internal electrode 40 and a second intermediate electrical conductor 60. In the present embodiment, the first electrical conductor group CG1 includes the first internal electrode 30 and the first intermediate electrical conductor 50, and the second electrical conductor group CG2 includes the second internal electrode 40 and the second intermediate electrical conductor 60.

In the first electrical conductor group CG1, the first internal electrode 30 includes a pair of end edges 30*a* and 30*b*. The pair of end edges 30*a* and 30*b* define both ends of the first internal electrode 30 in the second direction D2. The first internal electrode 30 is exposed at one of both ends of the element body 1. In the present embodiment, the end edge 30*a* is exposed at the end surface 1*c*. The first internal electrode 30 is connected to the first external electrode 10. The end edge 30*a* is connected to the electrode layer E1 of the first external electrode 10. The end edge 30*b* is separated from the end surface 1*d* and is not exposed at the end surface 1*d*. The first internal electrode 30 includes a pair of end edges 30*c* and 30*d*. The pair of end edges 30*c* and 30*d* define both ends of the first internal electrode 30 in the third direction D3. The end edge 30*c* is separated from the side surface 1*e*. The end edge 30*d* is separated from the side surface 1*f*.

The first internal electrode 30 has a rectangular shape when viewed from the first direction D1. The term "rectangular shape" as used herein includes, for example, a shape in which each corner is chamfered and a shape in which each corner is rounded. In the first internal electrode 30, the length of the electrode in the second direction D2 is larger than, for example, the length of the electrode in the third direction D3.

The first intermediate electrical conductor 50 includes a pair of end edges 50*a* and 50*b*. The pair of end edges 50*a* and 50*b* define both ends of the first intermediate electrical conductor 50 in the second direction D2. The end edge 50*a* is separated from the end surface 1*c*. The end edge 50*a* is separated from the first external electrode 10. The end edge 50*b* is separated from the end surface 1*d*. The end edge 50*b* is separated from the second external electrode 20. The first intermediate electrical conductor 50 is not connected to the first and second external electrodes 10 and 20. The first intermediate electrical conductor 50 includes a pair of end edges 50*c* and 50*d*. The pair of end edges 50*c* and 50*d* define both ends of the first intermediate electrical conductor 50 in the third direction D3. The end edge 50*c* is separated from the side surface 1*e*. The end edge 50*d* is separated from the side surface 1*f*.

The first intermediate electrical conductor 50 has, for example, a rectangular shape when viewed from the first direction D1. The length of the first intermediate electrical conductor 50 in the second direction D2 is larger than, for example, the length of the first intermediate electrical conductor 50 in the third direction D3.

In the second electrical conductor group CG2, the second internal electrode 40 includes a pair of end edges 40*a* and 40*b*. The pair of end edges 40*a* and 40*b* define both ends of the second internal electrode 40 in the second direction D2. The second internal electrode 40 is exposed at another end of both ends of the element body 1. In the present embodiment, the end edge 40*b* is exposed at the end surface 1*d*. The second internal electrode 40 is connected to the second external electrode 20. The end edge 40*b* is connected to the electrode layer E1 of the second external electrode 20. The end edge 40*a* is separated from the end surface 1*c* and is not exposed at the end surface 1*c*. The second internal electrode 40 includes a pair of end edges 40*c* and 40*d*. The pair of end edges 40*c* and 40*d* define both ends of the second internal electrode 40 in the third direction D3. The end edge 40*c* is separated from the side surface 1*e*. The end edge 40*d* is separated from the side surface 1*f*.

The second internal electrode 40 has a rectangular shape when viewed from the first direction D1. In the second internal electrode 40, the length of the electrode in the second direction D2 is larger than, for example, the length of the electrode in the third direction D3. In the present embodiment, the second internal electrode 40 has the same shape as the first internal electrode 30 when viewed from the first direction D1.

The second intermediate electrical conductor 60 includes a pair of end edges 60*a* and 60*b*. The pair of end edges 60*a* and 60*b* define both ends of the first intermediate electrical conductor 60 in the second direction D2. The end edge 60*a* is separated from the end surface 1*c*. The end edge 60*a* is separated from the first external electrode 10. The end edge 60*b* is separated from the end surface 1*d*. The end edge 60*b* is separated from the second external electrode 20. The second intermediate electrical conductor 60 is not connected to the first and second external electrodes 10 and 20. The first intermediate electrical conductor 60 includes a pair of end edges 60*c* and 60*d*. The pair of end edges 60*c* and 60*d* define both ends of the second intermediate electrical conductor 60 in the third direction D3. The end edge 60*c* is separated from the side surface 1*e*. The end edge 60*d* is separated from the side surface 1*f*.

The second intermediate electrical conductor 60 has, for example, a rectangular shape when viewed from the first direction D1. The length of the second intermediate electrical conductor 60 in the second direction D2 is larger than, for example, the length of the second intermediate electrical conductor 60 in the third direction D3. In the present embodiment, the second intermediate electrical conductor 60 has, for example, the same shape as the first intermediate electrical conductor 50 when viewed from the first direction D1.

In the present embodiment, the first intermediate electrical conductor 50 is separated from the first internal electrode 30, the second intermediate electrical conductor 60, and the second internal electrode 40 in the first direction D1. The first intermediate electrical conductor 50 is disposed between the first internal electrode 30, and the second intermediate electrical conductor 60 and the second internal electrode 40. The first intermediate electrical conductor 50 is opposed to the first internal electrode 30 in the first direction D1. The second intermediate electrical conductor 60 is separated from the first internal electrode 30, the first intermediate electrical conductor 50, and the second internal electrode 40 in the first direction D1. The second intermediate electrical conductor 60 is disposed between the first internal electrode 30 and the first intermediate electrical conductor 50, and the second internal electrode 40. The second intermediate electrical conductor 60 is opposed to the second internal electrode 40 in the first direction D1. In the present embodiment, the first internal electrode 30, the first intermediate electrical conductor 50, the second intermediate electrical conductor 60, and the second internal electrode 40 are arranged in this order in the first direction D1.

The first and second electrical conductor groups CG1 and CG2 are disposed in the element body 1 such that the first intermediate electrical conductor 50 and the second intermediate electrical conductor 60 are opposed to each other. The first intermediate electrical conductor 50 and the second intermediate electrical conductor 60 are opposed to each other in a direction where the first internal electrode 30 and the first intermediate electrical conductor 50 are opposed to each other and in a direction where the second internal electrode 40 and the second intermediate electrical conductor 60 are opposed to each other. In the present embodiment, the first internal electrode 30 and the first intermediate electrical conductor 50 are opposed to each other in the first direction D1. The second internal electrode 40 and the second intermediate electrical conductor 60 are opposed to each other in the first direction D1. The first and second electrical conductor groups CG1 and CG2 are disposed in the element body 1 such that the first intermediate electrical conductor 50 and the second intermediate electrical conductor 60 are opposed to each other in the first direction D1.

The first and second internal electrodes 30 and 40 are opposed in the first direction D1 to each other in a state where the first and second intermediate electrical conductors 50 and 60 are located between the first and second internal electrodes 30 and 40. That is, the first and second internal electrodes 30 and 40 are indirectly opposed in the first direction D1 to each other. As illustrated in FIG. 4, when viewed from the first direction D1, the first and second internal electrodes 30 and 40 include a first region AR1 and a second region AR2. In the first region AR1, the first and second internal electrodes 30 and 40 are opposed to each other in the first direction D1 when viewed from the first direction D1. In the second region AR2, the first and second internal electrodes 30 and 40 are not opposed to each other in the first direction D1. The first region AR1 has a rectangular shape when viewed from the first direction D1. In the example illustrated in FIG. 4, the end edge 30*c* and the end edge 40*c* include portions that coincide with each other when viewed from the first direction D1. The end edge 30*d* and the end edge 40*d* include portions that coincide with each other when viewed from the first direction D1. The first and second intermediate electrical conductors 50 and 60 overlap each other when viewed from the first direction D1.

In the present embodiment, the first region AR1 is defined by the end edge 40*a*, the end edge 30*b*, the end edge 30*c*, and the end edge 30*d* when viewed from the first direction D1. The first region AR1 may be defined by the end edge 40*a*, the end edge 30*b*, the end edge 40*c*, and the end edge 40*d* when viewed from the first direction D1. In a case where the first internal electrode 30 and the second internal electrode 40 are opposed to each other in a state the first and second intermediate electrical conductors 50 and 60 are located between the first and second internal electrodes 30 and 40, the area of the region in which the first internal electrode 30 and the second internal electrode 40 overlap each other when viewed from the first direction D1 is an opposing area of the first internal electrode 30 and the second internal electrode 40. In the present embodiment, the opposing area of the first internal electrode 30 and the second internal electrode 40 corresponds to an area of the first region AR1.

In the present embodiment, a distance WF1 in the second direction D2 between the end edge 40*a* and the end edge 30*b* defining the rectangular shape of the first region AR1 is, for example, 0.5 to 0.8 mm. A distance WF2 in the third direction D3 between the end edge 30*c* and the end edge 30*d* defining the rectangular shape of the first region AR1 is, for example, 0.15 to 0.25 mm. An area of the first region AR1 is, for example, 0.075 to 0.2 $mm^2$.

The element body 1 includes a first element body region V1 between the first internal electrode 30 and the second internal electrode 40 in the first region AR1, and a second element body region V2 excluding the first element body region V1. The first element body region V1 is positioned between the first internal electrode 30 and the second internal electrode 40 in the first direction D1 in the element body 1. A bottom surface of the first element body region V1 is defined by the first region AR1. A height of the first element body region V1 is defined by an interval ED1 between the first internal electrode 30 and the second internal electrode 40. The interval ED1 is, for example, 0.15 to 0.3 mm.

The first internal electrode 30 is separated from the first intermediate electrical conductor 50 in the first direction D1. An interval SC1 between the first internal electrode 30 and the first intermediate electrical conductor 50 in the first direction D1 is, for example, larger than 0 mm and 0.08 mm or less. The first intermediate electrical conductor 50 is separated from the second intermediate electrical conductor 60 in the first direction D1. A distance SC2 between the first intermediate electrical conductor 50 and the second intermediate electrical conductor 60 in the first direction D1 is, for example, larger than 0 mm and 0.08 mm or less. The second intermediate electrical conductor 60 is separated from the second internal electrode 40 in the first direction D1. A distance SC3 between the second intermediate electrical conductor 60 and the second internal electrode 40 in the first direction D1 is, for example, larger than 0 mm and 0.08 mm or less. The interval SC1, the interval SC2, and the interval SC3 may be equal to each other. The first internal electrode 30 is separated from the principal surface 1*a* in the first direction D1. An interval between the first internal electrode 30 and the principal surface 1*a* in the first direction D1 is, for example, larger than 0 mm and 0.3 mm or less. The second internal electrode 40 is separated from the principal surface 1*b* in the first direction D1. An interval between the second internal electrode 40 and the principal surface 1*b* in the first direction D1 is, for example, larger than 0 mm and 0.3 mm or less. The interval between the first internal electrode 30 and the principal surface 1*a* and the interval between the second internal electrode 40 and the principal surface 1*b* may be larger than any of the interval SC1, the interval SC2, and the interval SC3.

Thicknesses of the first and second internal electrodes 30 and 40 are, for example, 5 μm. The thicknesses of the first and second internal electrodes 30 and 40 may be equal to each other. Thicknesses of the first and second intermediate electrical conductors 50 and 60 are, for example, 5 μm. The thicknesses of the first and second intermediate electrical conductors 50 and 60 may be equal to each other. The thicknesses of the first and second internal electrodes 30 and 40 and the thicknesses of the first and second intermediate electrical conductors 50 and 60 may be equal to each other.

A length WH1 of the first internal electrode 30 in the second direction D2 is, for example, 0.7 to 0.9 mm. A length WH2 of the first internal electrode 30 in the third direction D3 is, for example, 0.15 to 0.25 mm. A length WH3 of the second internal electrode 40 in the second direction D2 is, for example, 0.7 to 0.9 mm. A length WH4 of the second internal electrode 40 in the third direction D3 is, for example, 0.15 to 0.25 mm. In the present embodiment, the length WH1 and the length WH3 may be equal to each other, and the length WH2 and the length WH4 may be equal to each other.

As illustrated in FIGS. 2 and 3, the end edge 50*a* is separated from the end edge 40*a* with a distance SV1 in the second direction D2 when viewed from the third direction D3. When viewed from the third direction D3, the end edge 50*b* is separated from the end edge 30*b* with a distance SV2 in the second direction D2. When viewed from the third direction D3, the end edge 60*a* is separated from the end edge 40*a* with a distance SV5 in the second direction D2. When viewed from the third direction D3, the end edge 60*b* is separated from the end edge 30*b* with a distance SV6 in the second direction D2. In the present embodiment, the distance SV1 and the distance SV5 are, for example, 0 to 0.08 mm. The distance SV1 and the distance SV5 may be equal to each other. The distance SV2 and the distance SV6 are, for example, 0 to 0.08 mm. The distance SV2 and the distance SV6 may be equal to each other.

When viewed from the second direction D2, the end edge 50*c* is separated from the end edge 30*c* with a distance SV3 in the third direction D3. When viewed from the second direction D2, the end edge 50*d* is separated from the end edge 30*d* with a distance SV4 in the third direction D3. The distance SV3 and the distance SV4 are, for example, 0 to 0.08 mm. The distance SV3 and the distance SV4 may be equal to each other.

A length WM1 of the first intermediate electrical conductor 50 in the second direction D2 is, for example, 0.4 to 0.7 mm. A length WM2 of the first intermediate electrical conductor 50 in the third direction D3 is, for example, 0.15 to 0.25 mm. An area of the first intermediate electrical conductor 50 viewed from the first direction D1 is, for example, 0.06 to 0.18 $mm^2$.

When viewed from the second direction D2, the end edge 60*c* is separated from the end edge 40*c* with a distance SV7 in the third direction D3. When viewed from the second direction D2, the end edge 60*d* is separated from the end edge 40*d* with a distance SV8 in the third direction D3. The distance SV7 and the distance SV8 are, for example, 0 to 0.08 mm. The distance SV7 and the distance SV8 may be equal to each other.

A length WM3 of the second intermediate electrical conductor 60 in the second direction D2 is, for example, 0.4 to 0.7 mm. A length WM4 of the second intermediate electrical conductor 60 in the third direction D3 is, for example, 0.15 to 0.25 mm. The area of the second intermediate electrical conductor 60 is, for example, 0.06 to 0.18 $mm^2$.

In the first electrical conductor group CG1, the first internal electrode 30 and the first intermediate electrical conductor 50 overlap each other in the element body 1 when viewed from the first direction D1. An area of the region in which the first internal electrode 30 and the first intermediate electrical conductor 50 overlap each other is the opposing area of the first internal electrode 30 and the first intermediate electrical conductor 50. In the present embodiment, when viewed from the first direction D1, a part of the first intermediate electrical conductor 50 may be positioned in the first region AR1, and the entire first intermediate electrical conductor 50 may be positioned in the first region AR1. At least a part of the first intermediate electrical conductor 50 is positioned in the first region AR1 when viewed from the first direction D1. FIGS. 2 to 4 illustrate an example in which the entire first intermediate electrical conductor 50 is positioned in the first region AR1 when viewed from the first direction D1.

A ratio of the opposing area of the first internal electrode 30 and the first intermediate electrical conductor 50 to the opposing area of the first internal electrode 30 and the second internal electrode 40 is, for example, 0.5 to 1.0. The ratio of the opposing area being 1.0 means that the area of the first intermediate electrical conductor 50 and the area of the first region AR1 in the first direction D1 are equal to each other. The ratio of the opposing area being 0.5 means that the area of the first intermediate electrical conductor 50 in the first direction D1 is half the area of the first region AR1.

In the second electrical conductor group CG2, the second internal electrode 40 and the second intermediate electrical conductor 60 overlap each other in the element body 1 when viewed from the first direction D1. The area of the region in which the second internal electrode 40 and the second intermediate electrical conductor 60 overlap each other is the opposing area of the second internal electrode 40 and the second intermediate electrical conductor 60. In the present embodiment, when viewed from the first direction D1, a part of the second intermediate electrical conductor 60 may be positioned in the first region AR1, and the entire second intermediate electrical conductor 60 may be positioned in the first region AR1. At least a part of the second intermediate electrical conductor 60 is positioned in the first region AR1 when viewed from the first direction D1. FIGS. 2 to 4 illustrate an example in which the entire second intermediate electrical conductor 60 is positioned in the first region AR1 when viewed from the first direction D1. FIG. 4 illustrates an example in which an outer edge of the first intermediate electrical conductor 50 and an outer edge of the second intermediate electrical conductor 60 coincide with each other when viewed from the first direction D1. In the present embodiment, a ratio of the opposing area of the second internal electrode 40 and the second intermediate electrical conductor 60 to the opposing area of the first internal electrode 30 and the second internal electrode 40 is, for example, 0.5 to 1.0.

In the multilayer chip varistor EC1, the first and second internal electrodes 30 and 40 include a first electrically conductive material. In the present embodiment, the first electrically conductive material includes Pd (palladium). The first electrically conductive material may include Ag, Cu, Au, Pt, or an alloy thereof. The first and second internal electrodes 30 and 40 are each configured as, for example, a sintered body of a conductive paste including the first electrically conductive material. In the present embodiment, the first and second internal electrodes 30 and 40 include Pd.

The first and second intermediate electrical conductors 50 and 60 include, for example, the first electrically conductive material. The first and second intermediate electrical conductors 50 and 60 include a second electrically conductive material different from the first electrically conductive material. In the present embodiment, at least one of the first and second intermediate electrical conductors 50 and 60 includes the second electrically conductive material. The second electrically conductive material includes an electrically conductive material having a low electrical resistance, for example, Al (aluminum). The second electrically conductive material may include, for example, Ga or In. The first and second intermediate electrical conductors 50 and 60 are each configured as a sintered body of a conductive paste including the first electrically conductive material and the second electrically conductive material. In the present embodiment, the first and second intermediate electrical conductors 50 and 60 mainly include the first electrically conductive material, and the first electrically conductive material included in the first and second intermediate electrical conductors 50 and 60 includes Pd.

A content of the second electrically conductive material in the first intermediate electrical conductor 50 is, for example, larger than 0 atomic % (atm %) and 5 atomic % or less. The content of the second electrically conductive material in the first intermediate electrical conductor 50 may be, for example, 0.1 atomic % or more and 3 atomic % or less. A content of the second electrically conductive material in the second intermediate electrical conductor 60 is, for example, larger than 0 atomic % and 5 atomic % or less. The content of the second electrically conductive material in the second intermediate electrical conductor 60 may be, for example, 0.1 atomic % or more and 3 atomic % or less. In the present embodiment, the contents of the second electrically conductive material in the first and second intermediate electrical conductors 50 and 60 may be equal to each other.

At least a part of each of the first and second intermediate electrical conductors 50 and 60 is included in the first element body region V1. The part of each of the first and second intermediate electrical conductors 50 and 60 may be positioned in the first element body region V1, and the entirety of each of the first and second intermediate electrical conductors 50 and 60 may be positioned in the first element body region V1. The first and second intermediate electrical conductors 50 and 60 are each configured as, for example, a sintered body of a conductive paste including the second electrically conductive material. In the first element body region V1, the second electrically conductive material different from the first electrically conductive material is diffused. The second element body region V2 includes a region in which the second electrically conductive material is not diffused. In the region in which the second electrically conductive material is diffused, the electrical resistance of the region is reduced. At least the part of each of the first and second intermediate electrical conductors 50 and 60 is disposed between the first and second internal electrodes 30 and 40. The element body 1 includes a low electrical resistance region which is positioned between the first and second internal electrodes 30 and 40, and in which the second electrically conductive material is diffused.

In the present embodiment, in addition to the first and second intermediate electrical conductors 50 and 60, the first and second internal electrodes 30 and 40 may include the second electrically conductive material having the low electrical resistance in addition to the first electrically conductive material. The content of the second electrically conductive material in the first and second internal electrodes 30 and 40 is, for example, 0 atomic % or more and 0.5 atomic % or less. The content of the second electrically conductive material in the first and second internal electrodes 30 and 40 may be, for example, larger than 0 atomic % and 0.3 atomic % or less. In a case where the first and second internal electrodes 30 and 40 include the second electrically conductive material having the low electrical resistance in addition to the first electrically conductive material, the content of the second electrically conductive material in the first and second intermediate electrical conductors 50 and 60 may be equal to or larger than the content of the second electrically conductive material in each of the first and second internal electrodes 30 and 40.

The multilayer chip varistor EC1 includes a first internal electrical conductor 55 and a second internal electrical conductor 65 in the element body 1. The first internal electrical conductor 55 is disposed in the same layer as at least one intermediate electrical conductor of the first and second intermediate electrical conductors 50 and 60. The first internal electrical conductor 55 is separated from the at least one intermediate electrical conductor. The element body 1 is a ceramic element body formed by laminating a plurality of varistor layers in the first direction D1. As illustrated in FIG. 2, the first internal electrical conductor 55 includes, for example, two electrical conductors. One electrical conductor constituting the first internal electrical conductor 55 is positioned in the same layer as the first intermediate electrical conductor 50. Another electrical conductor constituting the first internal electrical conductor 55 is positioned in the same layer as the second intermediate electrical conductor 60. The first internal electrical conductor 55 may include one electrical conductor. In a case where the first internal electrical conductor 55 is composed of one electrical conductor, the first internal electrical conductor 55 may be disposed in the same layer as one of the first and second intermediate electrical conductors 50 and 60.

The first internal electrical conductor 55 is exposed at one of both ends of the element body 1. The first internal electrical conductor 55 includes a pair of end edges. The pair of end edges define both ends of the first internal electrical conductor 55 in the second direction D2. In the present embodiment, one end edge of the pair of end edges is exposed at the end surface 1*c*. Another end edge of the pair of end edges is separated from the first and second intermediate electrical conductors 50 and 60 and is not exposed at the end surface 1*d*. The first internal electrical conductor 55 is connected to the first external electrode 10. In the present embodiment, one end edge of the pair of end edges is connected to the electrode layer E1 of the first external electrode 10. The first internal electrical conductor 55 includes another pair of end edges. The other pair of end edges define both ends of the first internal electrical conductor 55 in the third direction D3. The other pair of end edges are separated from both the side surface 1*e* and the side surface 1*f*. The first internal electrical conductor 55 has, for example, a rectangular shape when viewed from the first direction D1.

The second internal electrical conductor 65 is disposed in the same layer as at least one intermediate electrical conductor of the first and second intermediate electrical conductors 50 and 60. The second internal electrical conductor 65 is separated from the at least one intermediate electrical conductor. As illustrated in FIG. 2, the second internal electrical conductor 65 includes, for example, two electrical conductors. One electrical conductor constituting the second internal electrical conductor 65 is positioned in the same layer as the first intermediate electrical conductor 50. Another electrical conductor constituting the second internal electrical conductor 65 is positioned in the same layer as the second intermediate electrical conductor 60. The second internal electrical conductor 65 may include one electrical conductor. In a case where the second internal electrical conductor 65 is composed of one electrical conductor, the second internal electrical conductor 65 may be disposed in the same layer as one of the first and second intermediate electrical conductors 50 and 60.

The second internal electrical conductor 65 is exposed at one of both ends of the element body 1. The second internal electrical conductor 65 includes a pair of end edges. The pair of end edges define both ends of the second internal electrical conductor 65 in the second direction D2. In the present embodiment, one end edge of the pair of end edges is exposed at the end surface 1*d*. Another end edge of the pair of end edges is separated from the first and second intermediate electrical conductors 50 and 60 and is not exposed at the end surface 1*c*. The second internal electrical conductor 65 is connected to the second external electrode 20. In the present embodiment, one end edge of the pair of end edges is connected to the electrode layer E1 of the second external electrode 20. The second internal electrical conductor 65 includes another pair of end edges. The other pair of end edges define both ends of the second internal electrical conductor 65 in the third direction D3. The other pair of end edges are separated from both the side surface 1*e* and the side surface 1*f*. The second internal electrical conductor 65 has, for example, a rectangular shape when viewed from the first direction D1. The first internal electrical conductor 55 and the second internal electrical conductor 65 may have the same shape as viewed from the first direction D1.

Lengths WN1 and WN3 of the first and second internal electrical conductors 55 and 65 in the second direction D2 are, for example, 0.005 to 0.1 mm. The lengths WN1 and WN3 may be equal to each other. Lengths WN2 and WN4 of the first and second internal electrical conductors 55 and 65 in the third direction D3 are, for example, 0.15 to 0.25 mm. The lengths WN2 and WN4 may be equal to each other. The thicknesses of the first and second internal electrical conductors 55 and 65 are, for example, 5 μm. The thicknesses of the first and second internal electrical conductors 55 and 65 may be equal to each other. The thicknesses of the first and second internal electrical conductors 55 and 65 may be equal to the thicknesses of the first and second intermediate electrical conductors 50 and 60.

The effect of the multilayer chip varistor EC1 according to the present embodiment will be described. The multilayer chip varistor EC1 includes the element body 1 that exhibits varistor characteristics, the first external electrode 10 and the second external electrode 20 disposed at both ends of the element body 1, and the first electrical conductor group CG1 and the second electrical conductor group CG2 disposed in the element body. The first electrical conductor group CG1 includes the first internal electrode 30 including the first electrically conductive material, the first internal electrode being exposed at one end of the ends and connected to the first external electrode 10. The first electrical conductor group CG1 includes the first intermediate electrical conductor 50 opposed to the first internal electrode 30 and not connected to the first and second external electrodes 10 and 20. The second electrical conductor group CG2 includes the second internal electrode 40 including the first electrically conductive material, the second internal electrode being exposed at another end of the ends and connected to the second external electrode 20. The second electrical conductor group CG2 includes the second intermediate electrical conductor 60 opposed to the second internal electrode 40 and not connected to the first and second external electrodes 10 and 20. The first and second electrical conductor groups CG1 and CG2 are disposed in the element body 1 such that the first intermediate electrical conductor 50 and the second intermediate electrical conductor 60 are opposed to each other in the direction where the first internal electrode 30 and the first intermediate electrical conductor 50 are opposed to each other and in the direction where the second internal electrode 40 and the second intermediate electrical conductor 60 are opposed to each other. At least one of the first and second intermediate electrical conductors 50 and 60 includes the second electrically conductive material different from the first electrically conductive material. The element body 1 includes the low electrical resistance region between the first and second internal electrodes 30 and 40, and the second electrically conductive material included in the at least one of the first and second intermediate electrical conductors 50 and 60 is diffused in the low electrical resistance region.

In the present embodiment, the element body 1 includes the region in which the second electrically conductive material included in the at least one of the first and second intermediate electrical conductors 50 and 60 is diffused between the first and second internal electrodes 30 and 40. The region in which the second electrically conductive material is diffused has the lower electrical resistance than the region in which the second electrically conductive material is not diffused. The multilayer chip varistor EC1 has the improved ESD tolerance. The configuration in which both the first and second intermediate electrical conductors 50 and 60 include the second electrically conductive material surely has the more improved ESD tolerance as compared with the configuration in which only one of the first and second intermediate electrical conductors 50 and 60 includes the second electrically conductive material.

The multilayer chip varistor EC1 includes the first internal electrical conductor 55 disposed in the same layer as at least one intermediate electrical conductor of the first and second intermediate electrical conductors 50 and 60, the first internal electrical conductor 55 being separated from the at least one intermediate electrical conductor, exposed at the one end, and connected to the first external electrode 10, and the second internal electrical conductor 65 disposed in the same layer as at least one intermediate electrical conductor of the first and second intermediate electrical conductors 50 and 60, the second internal electrical conductor being separated from the at least one intermediate electrical conductor, exposed at the other end, and connected to the second external electrode 20.

Therefore, the first internal electrical conductor 55 identifies that at least one intermediate electrical conductor of the first and second intermediate electrical conductors 50 and 60 is surely disposed in the same layer as the first internal electrical conductor 55. The second internal electrical conductor 65 identifies that at least one intermediate electrical conductor of the first and second intermediate electrical conductors 50 and 60 is surely disposed in the same layer as the second internal electrical conductor 65.

In the present embodiment, the first intermediate electrical conductor 50 includes the second electrically conductive material, and in this case, for example, both the first internal electrical conductor 55 and the second internal electrical conductor 65 are disposed in the same layer as the first intermediate electrical conductor 50. The first intermediate electrical conductor 50 may not include the second electrically conductive material. In a case where the second electrically conductive material is not included, for example, only one of the first internal electrical conductor 55 and the second internal electrical conductor 65 is disposed in the same layer as the first intermediate electrical conductor 50.

Therefore, the presence or absence of the second electrically conductive material in the first intermediate electrical conductor 50 can be determined due to the number of the disposed internal electrical conductors 55 and 65. The layer in which the first intermediate electrical conductor 50 is disposed is determined due to the positions of the disposed internal electrical conductors 55 and 65.

In the present embodiment, the second intermediate electrical conductor 60 includes the second electrically conductive material, and in this case, for example, both the first internal electrical conductor 55 and the second internal electrical conductor 65 are disposed in the same layer as the second intermediate electrical conductor 60. The second intermediate electrical conductor 60 may not include the second electrically conductive material. In a case where the second electrically conductive material is not included, for example, only one of the first internal electrical conductor 55 and the second internal electrical conductor 65 is disposed in the same layer as the second intermediate electrical conductor 60.

Therefore, the presence or absence of the second electrically conductive material in the second intermediate electrical conductor 60 can be determined due to the number of the disposed internal electrical conductors 55 and 65. The layer in which the second intermediate electrical conductor 60 is disposed is determined due to the positions of the disposed internal electrical conductors 55 and 65.

In the multilayer chip varistor EC1, the first and second internal electrodes 30 and 40 include the second electrically conductive material.

Therefore, the second electrically conductive material is diffused from the first and second internal electrodes 30 and 40 into the region between the first and second internal electrodes 30 and 40. As a result, the multilayer chip varistor EC1 surely has the improved ESD tolerance.

In the multilayer chip varistor EC1, the content of the second electrically conductive material in at least one intermediate electrical conductor of the first and second intermediate electrical conductors 50 and 60 is equal to or larger than the content of the second electrically conductive material in each of the first and second internal electrodes 30 and 40.

Therefore, the second electrically conductive material is more surely diffused from at least one of the first and second intermediate electrical conductors 50 and 60 in the region between the first and second internal electrodes 30 and 40. As a result, the multilayer chip varistor EC1 surely has the more improved ESD tolerance.

In the multilayer chip varistor EC1, the first and second intermediate electrical conductors 50 and 60 include the second electrically conductive material.

Therefore, the second electrically conductive material is diffused from the first and second intermediate electrical conductors 50 and 60 to the region between the first and second internal electrodes 30 and 40, and the electrical resistance is more surely reduced. The multilayer chip varistor EC1 surely has the more improved ESD tolerance.

Hereinafter, the multilayer chip varistor EC1 according to the present embodiment will be further described with reference to Examples and Comparative Examples of the present invention. The multilayer chip varistor EC1 will be described with reference to Examples 1 to 8 and Comparative Examples 1 to 3. The present invention is not limited to the following examples.

Example 1

A configuration of the multilayer chip varistor EC1 according to Example 1 is as follows.

In Example 1, the element body 1 has a rectangular parallelepiped shape. In the element body 1, the length W1 in the first direction D1 is 0.54 mm, the length W2 in the second direction D2 is 0.54 mm, and the length W3 in the third direction D3 is 1.09 mm. The shape and size of the element body in Examples 2 to 8 and Comparative Examples 1 to 3 described below are the same as the shape and size of the element body 1 in Example 1.

In the multilayer chip varistor EC1, the interval SC1, the interval SC2, and the interval SC3 are 0.055 mm. The interval between the first internal electrode 30 and the principal surface 1*a* and the interval between the second internal electrode 40 and the principal surface 1*b* are 0.18 mm. In Example 1, the interval SC1, the interval SC2, and the interval SC3 are equal to each other. In Examples 2 to 8 and Comparative Examples 1 to 3 described below, the interval SC1, the interval SC2, and the interval SC3 are equal to each other.

The first and second internal electrodes 30 and 40 and the first and second intermediate electrical conductors 50 and 60 have a rectangular shape when viewed from the first direction D1. The distance WF1 in the second direction D2 between the end edge 40*a* and the end edge 30*b* defining the rectangular shape of the first region AR1 is 0.62 mm. The distance WF2 in the third direction D3 between the end edge 30*c* and the end edge 30*d* defining the rectangular shape of the first region AR1 is 0.19 mm. The area of the first region AR1 when viewed from the first direction D1 is 0.12 $mm^2$.

The content of Al in the first and second internal electrodes 30 and 40 is 0 atomic %, and the content of Al in the first and second intermediate electrical conductors 50 and 60 is 0.1 atomic %.

In the first embodiment, the distance SV1 to the distance SV8 are 0 mm. The first and second intermediate electrical conductors 50 and 60 are positioned in the first element body region V1, and the areas of the first and second intermediate electrical conductors 50 and 60 when viewed from the first direction D1 are 0.12 $mm^2$. A ratio of the opposing area of the first and second intermediate electrical conductors 50 and 60 to the area of the first region AR1 when viewed from the first direction D1 is 1.0. A ratio of the opposing area of the first internal electrode 30 and the first intermediate electrical conductor 50 to the area of the first region AR1 is 1.0. A ratio of the opposing area of the second internal electrode 40 and the second intermediate electrical conductor 60 to the area of the first region AR1 is 1.0.

(ESD Tolerance Test)

In the ESD tolerance test, the ESD tolerance of the multilayer chip varistor EC1 is examined. The procedure of the ESD tolerance test is as follows.

In Example 1, the electrostatic discharge immunity test defined in the IEC (International Electrotechnical Commission) standard IEC61000-4-2 is performed. In a state in which a tip of a discharge gun is in contact with the multilayer chip varistor EC1, the discharge voltage (applied voltage) is changed in 2 kV steps. Ten contact discharges are conducted in each step. In Example 1, the ESD tolerance is estimated as a voltage value (kV) immediately before the rate of change of the varistor voltage change with respect to the initial value of the varistor voltage after discharge changes by 10% or more.

(Energy Resistance Test)

In the energy resistance test, the energy resistance of the multilayer chip varistor EC1 is examined. The procedure of the energy resistance test is as follows.

An impulse current of 10/1,000 μs is applied to the multilayer chip varistor EC1, and the electrical characteristics of the multilayer chip varistor EC1 are measured. In Example 1, the energy resistance is estimated as the maximum energy value (J) in which the impulse current is applied once and the electrical characteristics of the multilayer chip varistor EC1 are not deteriorated.

(Leakage Current Test)

In the leakage current test, the leakage current of the multilayer chip varistor EC1 is examined. In the leakage current test, a voltage of 70V is applied to the multilayer chip varistor EC1.

(Dynamic Resistance Test)

In the transmission line pulse (TLP) measurement, the dynamic resistance of the multilayer chip varistor EC1 is examined. In Example 1, a rectangular wave having a width of 100 nanoseconds is applied to the multilayer chip varistor EC1, and the current (I)/voltage (V) characteristics are evaluated. The dynamic resistance value is calculated from the IV characteristic of 10 amperes or more which is the high current region.

Example 2

In Example 2, the multilayer chip varistor EC1 is prepared and tested in the same manner as in Example 1 except that the content of Al in the first and second intermediate electrical conductors 50 and 60 is 0.5 atomic %.

Example 3

In Example 3, the multilayer chip varistor EC1 is prepared and tested in the same manner as in Example 1 except that the content of Al in the first and second intermediate electrical conductors 50 and 60 is 1 atomic %.

Example 4

In Example 4, the multilayer chip varistor EC1 is prepared and tested in the same manner as in Example 1 except that the content of Al in the first and second intermediate electrical conductors 50 and 60 is 3 atomic %.

Example 5

In Example 5, the multilayer chip varistor EC1 is prepared and tested in the same manner as in Example 1 except that the content of Al in the first and second intermediate electrical conductors 50 and 60 is 5 atomic %.

Example 6

In Example 6, the multilayer chip varistor EC1 is prepared and tested in the same manner as in Example 1 except that the content of Al in the first and second internal electrodes 30 and 40 is 0.5 atomic %, and the content of Al in the first and second intermediate electrical conductors 50 and 60 is 1.0 atomic %.

Example 7

In Example 7, the multilayer chip varistor EC1 is prepared and tested in the same manner as in Example 1 except that the content of Al in the first and second internal electrodes 30 and 40 is 0.5 atomic %, and the content of Al in the first and second intermediate electrical conductors 50 and 60 is 0.5 atomic %.

Example 8

In Example 8, the multilayer chip varistor EC1 is prepared and tested in the same manner as in Example 2 except that the distance SV1 to the distance SV8 are 40 μm, and the ratio of the opposing area of the first and second intermediate electrical conductors 50 and 60 to the area of the first region AR1 in the first direction D1 is 0.74.

Example 9

In Example 9, the multilayer chip varistor EC1 is prepared and tested in the same manner as in Example 2 except that the distance SV1 to the distance SV8 are 80 μm, and the ratio of the opposing area of the first and second intermediate electrical conductors 50 and 60 to the area of the first region AR1 in the first direction D1 is 0.5.

Comparative Example 1

In Comparative Example 1, the multilayer chip varistor is prepared and tested in the same manner as in Example 2 except that the second intermediate electrical conductor 50 is not disposed among the first and second intermediate electrical conductors 50 and 60. The first intermediate electrical conductor 50 is positioned just in the middle of the first and second internal electrodes 30 and 40 in the first direction D1. In Comparative Example 1, the number of intermediate electrical conductors is one.

Comparative Example 2

In Comparative Example 2, the multilayer chip varistor is prepared and tested in the same manner as in Example 2 except that three intermediate electrical conductors are disposed between the first and second internal electrodes 30 and 40 in the first direction D1. The first and second intermediate electrical conductors 50 and 60 and another one intermediate electrical conductor are disposed at equal intervals between the first and second internal electrodes 30 and 40 in the first direction D1.

Comparative Example 3

In Comparative Example 3, the multilayer chip varistor is prepared and tested in the same manner as in Example 2 except that four intermediate electrical conductors are disposed between the first and second internal electrodes 30 and 40 in the first direction D1. The first and second intermediate electrical conductors 50 and 60 and other two intermediate electrical conductors are disposed at equal intervals between the first and second internal electrodes 30 and 40 in the first direction D1.

Comparative Example 4

In Comparative Example 4, the multilayer chip varistor is prepared and tested in the same manner as in Example 1 except that the distance SV1 to the distance SV8 are 40 μm, the ratio of the opposing area of the first and second intermediate electrical conductors 50 and 60 to the area of the first region AR1 in the first direction D1 is 0.74, and the content of Al in the first and second intermediate electrical conductors 50 and 60 is 0 atomic %.

Comparative Example 5

In Comparative Example 5, the multilayer chip varistor is prepared and tested in the same manner as in Example 1 except that the distance SV1 to the distance SV8 are 80 μm, the ratio of the opposing area of the first and second intermediate electrical conductors 50 and 60 to the area of the first region AR1 in the first direction D1 is 0.5, and the content of Al in the first and second intermediate electrical conductors 50 and 60 is 0 atomic %.

Comparative Example 6

In Comparative Example 6, the multilayer chip varistor is prepared and tested in the same manner as in Example 1 except that the distance SV1 to the distance SV8 are 90 μm, the ratio of the opposing area of the first and second intermediate electrical conductors 50 and 60 to the area of the first region AR1 in the first direction D1 is 0.45, and the content of Al in the first and second intermediate electrical conductors 50 and 60 is 0 atomic %.

Comparative Example 7

In Comparative Example 7, the multilayer chip varistor is prepared and tested in the same manner as in Example 1 except that the distance SV1 to the distance SV8 are −20 μm, the ratio of the opposing area of the first and second intermediate electrical conductors 50 and 60 to the area of the first region AR1 in the first direction D1 is 1.1, and the content of Al in the first and second intermediate electrical conductors 50 and 60 is 0 atomic %. The notation that the distance SV1 to the distance SV8 are −20 μm indicates that the intermediate electrical conductors 50 and 60 extend to the outside of the first region AR1 when viewed from the first direction D1. The end edges of the intermediate electrical conductors 50 and 60 are positioned outside the first region AR1 by 20 μm on both sides of the first region AR1 in the second direction D2. The end edges of the intermediate electrical conductors 50 and 60 are positioned outside the first region AR1 with 20 μm on both sides of the first region AR1 in the third direction D3. In this comparative example, the ratio of the opposing area is 1.1.

Comparative Example 8

In Comparative Example 8, the multilayer chip varistor is prepared and tested in the same manner as in Example 1 except that the distance SV1 to the distance SV8 are −40 μm, the ratio of the opposing area of the first and second intermediate electrical conductors 50 and 60 to the area of the first region AR1 in the first direction D1 is 1.3, and the content of Al in the first and second intermediate electrical conductors 50 and 60 is 0 atomic %.

Comparative Example 9

In Comparative Example 9, the multilayer chip varistor is prepared and tested in the same manner as in Example 2 except that the distance SV1 to the distance SV8 are 90 μm, and the ratio of the opposing area of the first and second intermediate electrical conductors 50 and 60 to the area of the first region AR1 in the first direction D1 is 0.45.

Comparative Example 10

In Comparative Example 10, the multilayer chip varistor is prepared and tested in the same manner as in Example 2 except that the distance SV1 to the distance SV8 are −20 μm, and the ratio of the opposing area of the first and second intermediate electrical conductors 50 and 60 to the area of the first region AR1 in the first direction D1 is 1.1.

Comparative Example 11

In Comparative Example 11, the multilayer chip varistor is prepared and tested in the same manner as in Example 2 except that the distance SV1 to the distance SV8 are −40 μm, and the ratio of the opposing area of the first and second intermediate electrical conductors 50 and 60 to the area of the first region AR1 in the first direction D1 is 1.3.

FIG. 5 is a table illustrating the test results in Examples 1 to 9 according to the present embodiment. FIG. 5 illustrates various data of the multilayer chip varistors according to Examples, the results of the ESD tolerance test, the energy resistance test, the leakage current test, and the dynamic resistance test, and the results of the characteristic evaluations based on these test results. FIG. 6 is a table illustrating the test results in Comparative Example 1 to Comparative Example 11 according to the present embodiment. FIG. 6 illustrates various data of the multilayer chip varistors according to Comparative Examples, the results of the ESD tolerance test, the energy resistance test, the leakage current test, and the dynamic resistance test, and the results of the characteristic evaluations based on these test results. In FIGS. 5 and 6, the data of the multilayer chip varistor are the number of intermediate electrical conductors included in the multilayer chip varistor, the size of the distance SV1 to the distance SV8 (in the table, expressed as "Distance [μm] between End Edges"), the ratio of the opposing area of the intermediate electrical conductor to the first region AR1, the Al content [atm %] of the first and second internal electrodes, and the Al content [atm %] of the intermediate electrical conductor.

The evaluations in Examples and Comparative Examples are as follows.

In general, the multilayer chip varistor used in a high-speed communication network system based on the Ethernet standard desirably has an ESD tolerance of 15 kV or more. In the ESD tolerance test, when the maximum voltage value indicating the ESD tolerance is 20 kV or more, it is judged as "good".

The energy resistance of the multilayer chip varistor is generally desirably 0.03 J or more. In the energy resistance test, when the maximum energy value indicating the energy resistance is 0.03 J or more, it is judged as "good".

The leakage current of the multilayer chip varistor is generally desirably 1,000 nA (nanoampere) or less. In the leakage current test, when the leakage current is 1,000 nA or less, it is judged as "good". When the leakage current exceeds 1,000 nA, it is judged as "poor".

The dynamic resistance of the multilayer chip varistor is generally desirably 2Ω (ohm) or less. In the dynamic resistance test, when the dynamic resistance value is 2Ω or less, it is judged as "good". When the dynamic resistance value exceeds 2Ω, it is judged as "poor".

In FIGS. 5 and 6, When all the test results in the ESD tolerance test, the energy resistance test, the leakage current test, and the dynamic resistance test are judged as "good", the characteristic of the multilayer chip varistor is evaluated as "good". When any one of the test results in the ESD tolerance test, the energy resistance test, the leakage current test, and the dynamic resistance test is judged as "poor", the characteristic of the multilayer chip varistor is evaluated as "poor". In FIGS. 5 and 6, when the characteristic of the multilayer chip varistor is evaluated as "good", "A" is written in the evaluation column, and when the characteristic of the multilayer chip varistor is evaluated as "poor", "B" is written in the evaluation column.

As illustrated in FIG. 5, in Examples 1 to 9, the number of intermediate electrical conductors is two. The multilayer chip varistors EC1 of Examples 1 to 9 each include the first and second intermediate electrical conductors 50 and 60 between the first internal electrode 30 and the second internal electrode 40.

In each of Examples 1 to 9, the ratio of the opposing area of the first internal electrode 30 and the first intermediate electrical conductor 50 to the opposing area of the first internal electrode 30 and the second internal electrode 40 is 0.5 to 1.0. The ratio of the opposing area of the second internal electrode 40 and the second intermediate electrical conductor 60 to the opposing area of the first internal electrode 30 and the second internal electrode 40 is 0.5 to 1.0. In each of Examples 1 to 9, the content of Al in the first and second intermediate electrical conductors 50 and 60 is equal to or larger than the content of Al in the first and second internal electrodes 30 and 40. In Examples 6 and 7, when the content of Al in the first and second internal electrodes 30 and 40 is larger than 0, the content of Al in the first and second intermediate electrical conductors 50 and 60 is equal to or larger than the content of Al in the first and second internal electrodes 30 and 40. In each of Examples 1 to 9, the test results in the ESD tolerance test, the energy resistance test, the leakage current test, and the dynamic resistance test are judged as "good". In Examples 1 to 9, the characteristic of the multilayer chip varistor EC1 is evaluated as "good".

As illustrated in FIG. 6, in Comparative Examples 1 to 3, the number of intermediate electrical conductors is other than two. The multilayer chip varistor of Comparative Example 1 does not include one of the first and second intermediate electrical conductors 50 and 60. In Comparative Example 1, only one intermediate electrical conductor is disposed. The multilayer chip varistors of Comparative Examples 2 and 3 include other intermediate electrical conductors in addition to the first and second intermediate electrical conductors 50 and 60 between the first internal electrode 30 and the second internal electrode 40. In Comparative Example 2, three intermediate electrical conductors are disposed, and in Comparative Example 3, four intermediate electrical conductors are disposed.

In Comparative Example 1, the result of the dynamic resistance test is judged as "poor", and the characteristic of the multilayer chip varistor is evaluated as "poor". In Comparative Example 2 and Comparative Example 3, the result of the leakage current test is judged as "poor", and the characteristic of the multilayer chip varistor is evaluated as "poor".

In Comparative Examples 4 to 8, the content of Al in each of the first and second intermediate electrical conductors 50 and 60 is 0 atomic %. In Comparative Examples 4 to 8, the results of the ESD tolerance test, the energy resistance test, and the dynamic resistance test are judged as "poor". In Comparative Examples 4 to 8, the characteristic of the multilayer chip varistor is evaluated as "poor".

In Comparative Examples 9 to 11, the ratio of the opposing area is out of the range of 0.5 to 1.0. In Comparative Examples 9 to 11, the results of the ESD tolerance test, the energy resistance test, and the leakage current test are judged as "poor". In Comparative Examples 9 to 11, the characteristic of the multilayer chip varistor is evaluated as "poor".

Although the embodiments and examples of the present invention have been described above, the present invention is not necessarily limited to the above-described embodiments and examples, and various modifications can be made without departing from the gist thereof.

In the present embodiment, the first and second intermediate electrical conductors 50 and 60 may not include the second electrically conductive material. As described above, the configuration in which at least the one of the first and second intermediate electrical conductors 50 and 60 includes the second electrically conductive material includes a region in which the second electrically conductive material included in at least the one of the first and second intermediate electrical conductors 50 and 60 is diffused between the first and second internal electrodes 30 and 40. The region in which the second electrically conductive material is diffused has the lower electrical resistance than the region in which the second electrically conductive material is not diffused, and the multilayer chip varistor EC1 has the improved ESD tolerance.

In the embodiments and the examples, the multilayer chip varistor has been described as an example, but the applicable component is not limited to the above-described multilayer chip varistor. A component applicable to components other than the above-described multilayer chip varistor is, for example, a chip type electronic component including a varistor.

The present specification discloses the following supplementary notes.

(Supplementary Note 1)

A multilayer chip varistor including:

an element body exhibiting varistor characteristics;

a first external electrode and a second external electrode disposed at both ends of the element body;

a first internal electrode group disposed closer to one of the ends in the element body;

a second internal electrode group disposed closer to another of the ends in the element body; and an intermediate electrical conductor group disposed in a mid-region of the element body, wherein the first internal electrode group includes a first internal electrode and a second internal electrode, the first and second internal electrodes including a first electrically conductive material, being connected to the first external electrode, and opposed to each other, the second internal electrode group includes a third internal electrode and a fourth internal electrode, the third and fourth internal electrodes including the first electrically conductive material, being connected to the second external electrode, and opposed to each other, the intermediate electrical conductor group includes:

a first intermediate electrical conductor not connected to the first external electrode and the second external electrode, and opposed to the first internal electrode, the second internal electrode, the third internal electrode, and the fourth internal electrode; and a second intermediate electrical conductor not connected to the first external electrode and the second external electrode, and opposed to the first intermediate electrical conductor in a state where the first and third internal electrodes are located between the first and second intermediate electrical conductors, the first intermediate electrical conductor includes a second electrically conductive material different from the first electrically conductive material, and the element body includes a low electrical resistance region between the first, second, third, and fourth internal electrodes, and the first intermediate electrical conductor, and the second electrically conductive material included in the first intermediate electrical conductor is diffused in the low electrical resistance region.

(Supplementary Note 2)

The multilayer chip varistor according to Supplementary Note 1, wherein a ratio of an opposing area of the first internal electrode and the first intermediate electrical conductor to an area of the first intermediate electrical conductor is 0.10 to 0.17, a ratio of an opposing area of the second internal electrode and the first intermediate electrical conductor to the area of the first intermediate electrical conductor is 0.10 to 0.17, a ratio of an opposing area of the third internal electrode and the first intermediate electrical conductor to the area of the first intermediate electrical conductor is 0.10 to 0.17, and a ratio of an opposing area of the fourth internal electrode and the first intermediate electrical conductor to the area of the first intermediate electrical conductor is 0.10 to 0.17.

(Supplementary Note 3)

The multilayer chip varistor according to Supplementary Note 1 or 2, wherein the second intermediate electrical conductor includes the second electrically conductive material, and the element body further includes a low electrical resistance region between the first internal electrode and the third internal electrode, and the second intermediate electrical conductor, and the second electrically conductive material included in the second intermediate electrical conductor is diffused in the low electrical resistance region.

(Supplementary Note 4)

The multilayer chip varistor according to Supplementary Note 3, wherein a ratio of an opposing area of the first internal electrode and the second intermediate electrical conductor to an area of the second intermediate electrical conductor is 0.10 to 0.17, and a ratio of an opposing area of the third internal electrode and the second intermediate electrical conductor to the area of the second intermediate electrical conductor is 0.10 to 0.17.

(Supplementary Note 5)

The multilayer chip varistor according to any one of Supplementary Notes 1 to 4, wherein the first, second, third, and fourth internal electrodes further include the second electrically conductive material.

(Supplementary Note 6)

The multilayer chip varistor according to Supplementary Note 5, wherein a content of the second electrically conductive material in the first intermediate electrical conductor is equal to or larger than a content of the second electrically conductive material in each of the first, second, third, and fourth internal electrodes.

(Supplementary Note 7)

The multilayer chip varistor according to Supplementary Note 5 or 6, wherein a content of the second electrically conductive material in the second intermediate electrical conductor is equal to or larger than a content of the second electrically conductive material in each of the first and third internal electrodes.

(Supplementary Note 8)

The multilayer chip varistor according to any one of Supplementary Notes 1 to 7, wherein the intermediate electrical conductor group further includes a third intermediate electrical conductor not connected to the first external electrode and the second external electrode, and opposed to the first intermediate electrical conductor in a state where the second and fourth internal electrodes are located between the first and third intermediate electrical conductors, the third intermediate electrical conductor includes the second electrically conductive material, and the element body further includes a low electrical resistance region between the second internal electrode and the fourth internal electrode, and the third intermediate electrical conductor, and the second electrically conductive material included in the third intermediate electrical conductor is diffused in the low electrical resistance region.

(Supplementary Note 9)

The multilayer chip varistor according to Supplementary Note 8, wherein a ratio of an opposing area of the second internal electrode and the third intermediate electrical conductor to an area of the third intermediate electrical conductor is 0.10 to 0.17, and a ratio of an opposing area of the fourth internal electrode and the third intermediate electrical conductor to the area of the third intermediate electrical conductor is 0.10 to 0.17.

(Supplementary Note 10)

The multilayer chip varistor according to any one of Supplementary Notes 1 to 9, wherein the first electrically conductive material includes palladium, and the second electrically conductive material includes aluminum.

In connection with the above supplementary notes, the present specification includes the following supplementary notes. In the following aspects, the same reference numerals are used for the same elements or elements having the same functions, and redundant description is omitted.

Figure 7:
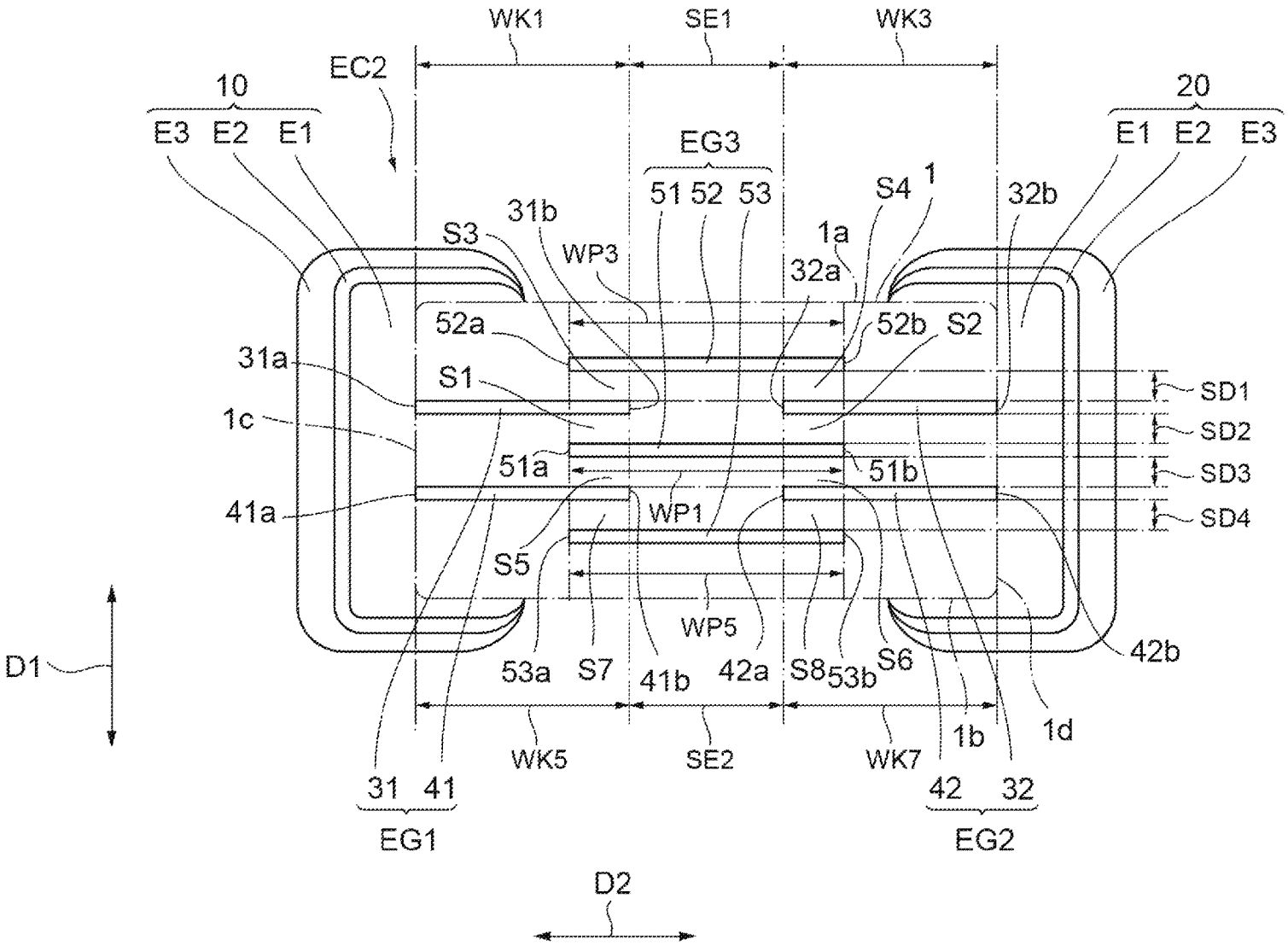
FIG. 7 is a schematic view illustrating a cross-sectional configuration of the multilayer chip varistor according to supplementary notes disclosed in the present specification.
Figure 8:
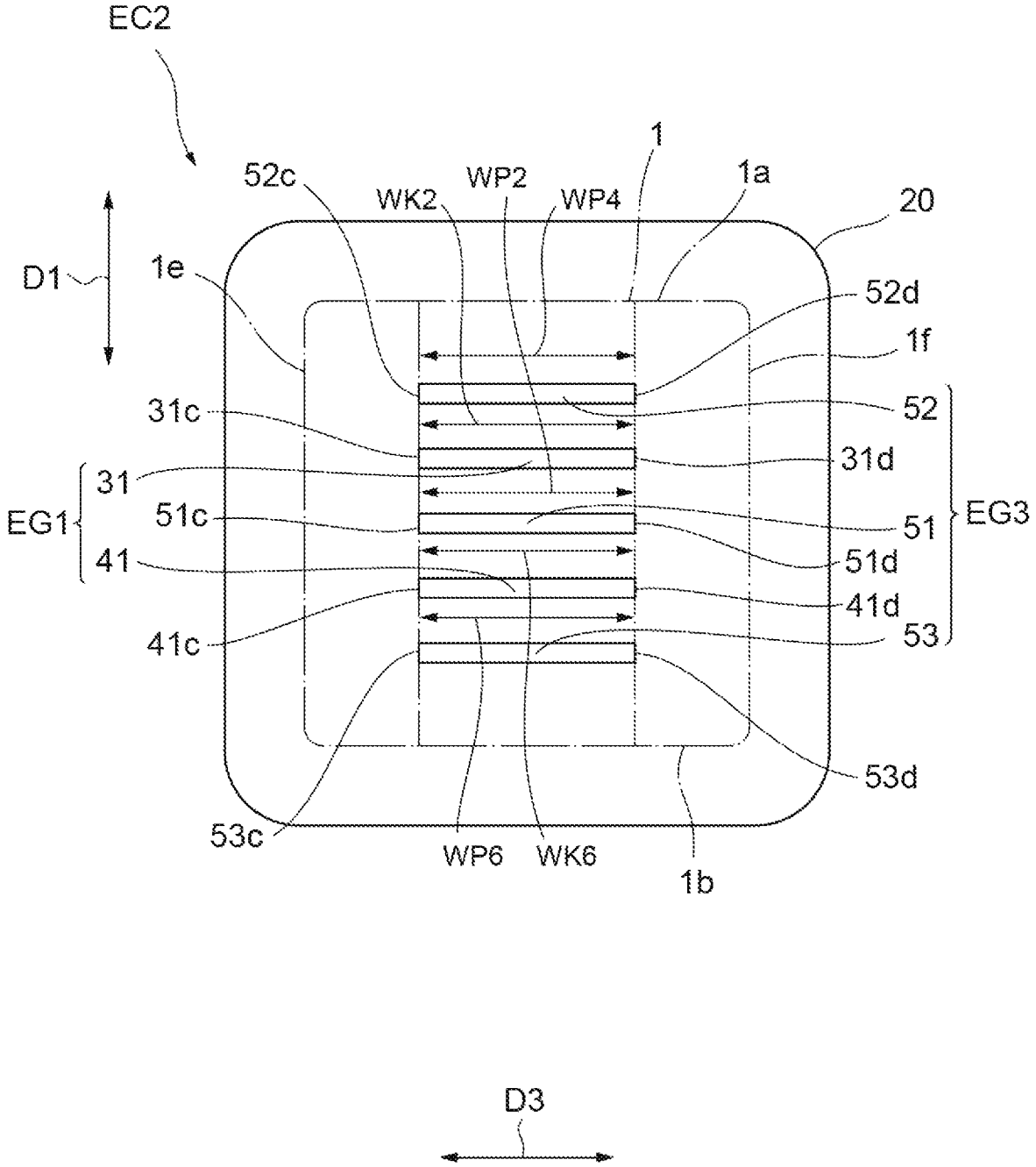
FIG. 8 is a schematic view illustrating a cross-sectional configuration of the multilayer chip varistor according to the present supplementary notes.
Figure 9:
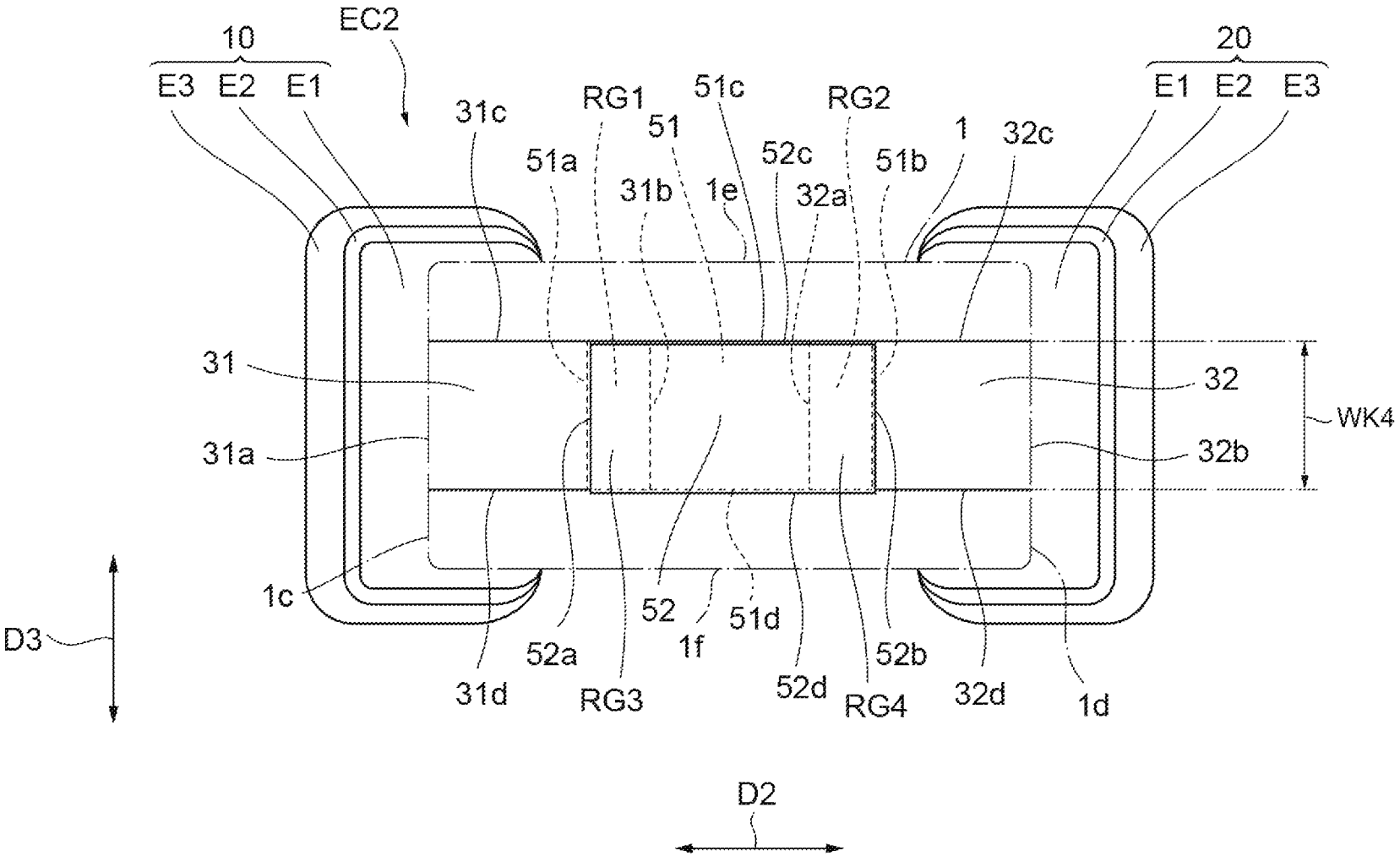
FIG. 9 is a schematic view illustrating a cross-sectional configuration of the multilayer chip varistor according to the present supplementary notes.
Figure 10:
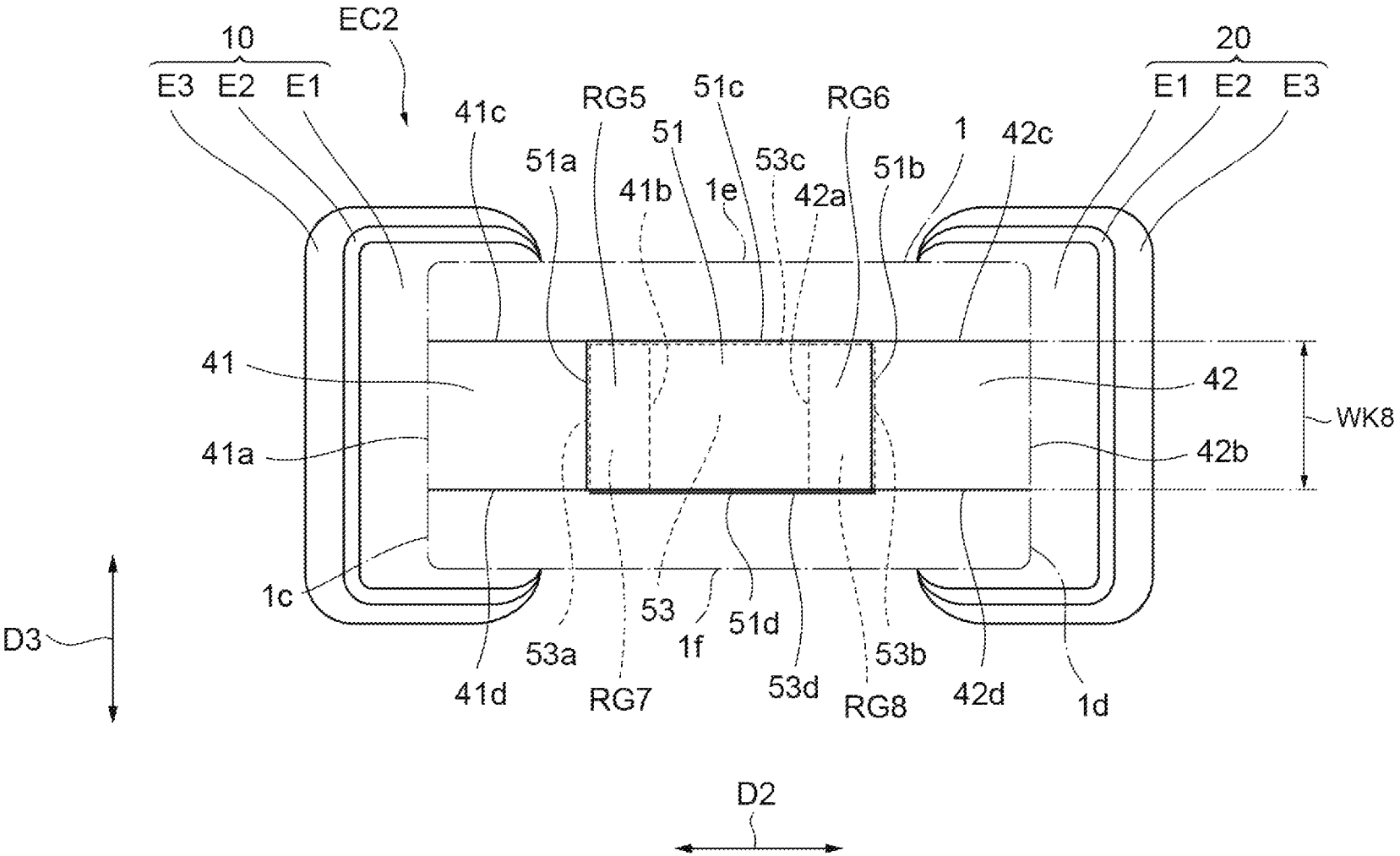
FIG. 10 is a schematic view illustrating a cross-sectional configuration of the multilayer chip varistor according to the present supplementary notes.

With reference to FIGS. 7 to 10, a configuration of a multilayer chip varistor EC2 according to the present supplementary notes will be described. FIG. 7 is a schematic view illustrating a cross-sectional configuration of the multilayer chip varistor according to the supplementary note disclosed in the present specification. FIG. 8 is a schematic view illustrating a cross-sectional configuration of the multilayer chip varistor according to the present supplementary notes. FIG. 9 is a schematic view illustrating a cross-sectional configuration of the multilayer chip varistor according to the present supplementary notes. In FIG. 9, for the sake of explanation, the second intermediate electrical conductor is intentionally shifted from the first intermediate electrical conductor and the first and second internal electrodes when viewed from the first direction. Actually, when viewed from the first direction, an outer edge of the second intermediate electrical conductor includes a portion overlapping an outer edge of the first intermediate electrical conductor and outer edges of the first and second internal electrodes. FIG. 10 is a schematic view illustrating a cross-sectional configuration of the multilayer chip varistor according to the present supplementary notes. In FIG. 10, for the sake of explanation, the third intermediate electrical conductor is intentionally shifted from the first intermediate electrical conductor and the third and fourth internal electrodes when viewed from the first direction. Actually, when viewed from the first direction, an outer edge of the third intermediate electrical conductor includes a portion overlapping an outer edge of the first intermediate electrical conductor and outer edges of the third and fourth internal electrodes.

The multilayer chip varistor EC2 includes an element body 1, first and second external electrodes 10 and 20 disposed on an outer surface of the element body 1, first and second internal electrode groups EG1 and EG2 disposed in the element body 1, and an intermediate electrical conductor group EG3 disposed in an intermediate portion of the element body 1. The element body 1 of the present supplementary notes includes semiconductor ceramic of the same material as the element body 1 of the above-described embodiment, and has the same multilayer structure as the element body 1 of the above-described embodiments. The element body 1 of the present supplementary notes includes the same outer surface as the element body 1 of the above-described embodiments.

The first external electrodes 10 and 20 of the present supplementary notes are disposed at both ends of the element body 1 opposed to each other in the second direction D2, similarly to the above-described embodiments. The first external electrode 10 is disposed at one end, and the second external electrode 20 is disposed at another end. In the present supplementary notes, the first external electrode 10 is disposed on the end surface 1*c*, and the second external electrode 20 is disposed on the end surface 1*d*. The first external electrodes 10 and 20 of the present supplementary notes include the same material as the first external electrodes 10 and 20 of the above-described embodiments, and have the same configuration as the first external electrodes 10 and 20 of the above-described embodiments.

The first and second internal electrode groups EG1 and EG2 will be described. The first internal electrode group EG1 is disposed closer to one end in the element body 1, and the second internal electrode group EG2 is disposed closer to another end in the element body 1.

The first internal electrode group EG1 includes a first internal electrode 31 and a second internal electrode 41. The first internal electrode 31 and the second internal electrode 41 are opposed to each other in the first direction D1. The second internal electrode group EG2 includes a third internal electrode 32 and a fourth internal electrode 42. The third internal electrode 32 and the fourth internal electrode 42 are opposed to each other in the first direction D1. The first and third internal electrodes 31 and 32 are separated from each other in the second direction D2 in the element body 1. The first and third internal electrodes 31 and 32 are disposed in the same layer in the element body 1, for example. The second and fourth internal electrodes 41 and 42 are separated from each other in the second direction D2 in the element body 1. The second and fourth internal electrodes 41 and 42 are disposed in the same layer in the element body 1, for example.

The first internal electrode 31 includes a pair of end edges 31*a* and 31*b*. The pair of end edges 31*a* and 31*b* define both ends of the first internal electrode 31 in the second direction D2. The first internal electrode 31 is exposed at one of both ends of the element body 1, and in the present supplementary notes, the end edge 31*a* is exposed at the end surface 1*c*. The first internal electrode 31 is connected to the first external electrode 10, and the end edge 31*a* is connected to the electrode layer E1 of the first external electrode 10. The end edge 31*b* is separated from the end surface 1*d* and is not exposed at the end surface 1*d*. The first internal electrode 31 includes a pair of end edges 31*c* and 31*d*. The pair of end edges 31*c* and 31*d* define both ends of the first internal electrode 31 in the third direction D3. The end edge 31*c* is separated from the side surface 1*e*. The end edge 31*d* is separated from the side surface 1*f*.

The third internal electrode 32 includes a pair of end edges 32*a* and 32*b*. The pair of end edges 32*a* and 32*b* define both ends of the third internal electrode 32 in the second direction D2. The third internal electrode 32 is exposed at another end of both ends of the element body 1, and in the present supplementary notes, the end edge 32*a* is exposed at the end surface 1*d*. The third internal electrode 32 is connected to the second external electrode 20, and the end edge 32*a* is connected to the electrode layer E1 of the second external electrode 20. The end edge 32*b* is separated from the end surface 1*c* and is not exposed at the end surface 1*c*. The third internal electrode 32 includes a pair of end edges 32*c* and 32*d*. The pair of end edges 32*c* and 32*d* define both ends of the third internal electrode 32 in the third direction D3. The end edge 32*c* is separated from the side surface 1*e*. The end edge 32*d* is separated from the side surface 1*f*.

The second internal electrode 41 includes a pair of end edges 41*a* and 41*b*. The pair of end edges 41*a* and 41*b* define both ends of the second internal electrode 41 in the second direction D2. The second internal electrode 41 is exposed at one of both ends of the element body 1, and in the present supplementary notes, the end edge 41*a* is exposed at the end surface 1*c*. The second internal electrode 41 is connected to the first external electrode 10, and the end edge 41*a* is connected to the electrode layer E1 of the first external electrode 10. The end edge 41*b* is separated from the end surface 1*d* and is not exposed at the end surface 1*d*. The second internal electrode 41 includes a pair of end edges 41*c* and 41*d*. The pair of end edges 41*c* and 41*d* define both ends of the second internal electrode 41 in the third direction D3. The end edge 41*c* is separated from the side surface 1*e*. The end edge 41*d* is separated from the side surface 1*f*.

The fourth internal electrode 42 includes a pair of end edges 42*a* and 42*b*. The pair of end edges 42*a* and 42*b* define both ends of the fourth internal electrode 42 in the second direction D2. The fourth internal electrode 42 is exposed at another end of both ends of the element body 1, and in the present supplementary notes, the end edge 42*b* is exposed at the end surface 1*d*. The fourth internal electrode 42 is connected to the second external electrode 20, and the end edge 42*b* is connected to the electrode layer E1 of the second external electrode 20. The end edge 42*a* is separated from the end surface 1*c* and is not exposed at the end surface 1*c*. The fourth internal electrode 42 includes a pair of end edges 42*c* and 42*d*. The pair of end edges 42*c* and 42*d* define both ends of the fourth internal electrode 42 in the third direction D3. The end edge 42*c* is separated from the side surface 1*e*. The end edge 42*d* is separated from the side surface 1*f*.

The first and second internal electrodes 31 and 41 and the third and fourth internal electrodes 32 and 42 include the same first electrically conductive material as the first and second internal electrodes 30 and 40 of the above-described embodiments. In the present supplementary notes, the first and second internal electrodes 31 and 41 and the third and fourth internal electrodes 32 and 42 include Pd.

The first and second internal electrodes 31 and 41 and the third and fourth internal electrodes 32 and 42 have a rectangular shape when viewed from the first direction D1. In the present supplementary notes, the first and second internal electrodes 31 and 41 and the third and fourth internal electrodes 32 and 42 have the same shape. The lengths of the first and second internal electrodes 31 and 41 in the second direction D2 are larger than the lengths of the first and second internal electrodes 31 and 41 in the third direction D3, for example. The lengths of the third and fourth internal electrodes 32 and 42 in the second direction D2 are larger than the lengths of the third and fourth internal electrodes 32 and 42 in the third direction D3, for example.

Lengths WK1 and WK3 of the first and third internal electrodes 31 and 32 in the second direction D2 are, for example, 0.35 to 0.55 mm. Lengths WK2 and WK4 of the first and third internal electrodes 31 and 32 in the third direction D3 are, for example, 0.15 to 0.25 mm. Lengths WK5 and WK7 of the second and fourth internal electrodes 41 and 42 in the second direction D2 are, for example, 0.35 to 0.55 mm. Lengths WK6 and WK8 of the second and fourth internal electrodes 41 and 42 in the third direction D3 are, for example, 0.15 to 0.25 mm. In the present supplementary notes, the length WK1 and the length WK3 may be equal to each other, and the length WK2 and the length WK4 may be equal to each other. The length WK5 and the length WK7 may be equal to each other, and the length WK6 and the length WK8 may be equal to each other. The length WK1 and the length WK5 may be equal to each other, and the length WK2 and the length WK6 may be equal to each other. The length WK3 and the length WK7 may be equal to each other, and the length WK4 and the length WK8 may be equal to each other.

The intermediate electrical conductor group EG3 will be described. The intermediate electrical conductor group EG3 includes a first intermediate electrical conductor 51 and a second intermediate electrical conductor 52. The first intermediate electrical conductor 51 is separated from the first internal electrode 31, the second internal electrode 41, the third internal electrode 32, and the fourth internal electrode 42 in the first direction D1. In the present supplementary notes, the first intermediate electrical conductor 51 is disposed between the first and third internal electrodes 31 and 32 and the second and fourth internal electrodes 41 and 42 in the first direction D1. The first intermediate electrical conductor 51 is opposed to the first internal electrode 31, the second internal electrode 41, the third internal electrode 32, and the fourth internal electrode 42.

The first intermediate electrical conductor 51 includes a pair of end edges 51*a* and 51*b*. The pair of end edges 51*a* and 51*b* define both ends of the first intermediate electrical conductor 51 in the second direction D2. The end edge 51*a* is separated from the end surface 1*c*. The end edge 51*a* is separated from the first external electrode 10. The end edge 51*b* is separated from the end surface 1*d*. The end edge 51*b* is separated from the second external electrode 20. The first intermediate electrical conductor 51 is not connected to the first and second external electrodes 10 and 20. The first intermediate electrical conductor 51 includes a pair of end edges 51*c* and 51*d*. The pair of end edges 51*c* and 51*d* define both ends of the first intermediate electrical conductor 51 in the third direction D3. The end edge 51*c* is separated from the side surface 1*e*. The end edge 51*d* is separated from the side surface 1*f*.

The first intermediate electrical conductor 51 has, for example, a rectangular shape when viewed from the first direction D1. The length of the first intermediate electrical conductor 51 in the second direction D2 is larger than, for example, the length of the first intermediate electrical conductor 51 in the third direction D3. A length WP1 of the first intermediate electrical conductor 51 in the second direction D2 is, for example, 0.5 to 0.7 mm. A length WP2 of the first intermediate electrical conductor 51 in the third direction D3 is, for example, 0.15 to 0.25 mm.

The second intermediate electrical conductor 52 is separated from the first internal electrode 31 and the third internal electrode 32 in the first direction D1. The second intermediate electrical conductor 52 is opposed to the first intermediate electrical conductor 51 in a state where the first and third internal electrodes 31 and 32 are located between the first and second intermediate electrical conductors 51 and 52. In the present supplementary notes, the second intermediate electrical conductor 52 is positioned, for example, between the first and third internal electrodes 31 and 32 and the principal surface 1*a* in the first direction D1. The second intermediate electrical conductor 52 is opposed to the first internal electrode 31 and the third internal electrode 32 in the first direction D1.

The second intermediate electrical conductor 52 includes a pair of end edges 52*a* and 52*b*. The pair of end edges 52*a* and 52*b* define both ends of the second intermediate electrical conductor 52 in the second direction D2. The end edge 52*a* is separated from the end surface 1*c*. The end edge 52*a* is separated from the first external electrode 10. The end edge 52*b* is separated from the end surface 1*d*. The end edge 52*b* is separated from the second external electrode 20. The second intermediate electrical conductor 52 is not connected to the first and second external electrodes 10 and 20. The second intermediate electrical conductor 52 includes a pair of end edges 52*c* and 52*d*. The pair of end edges 52*c* and 52*d* define both ends of the second intermediate electrical conductor 52 in the third direction D3. The end edge 52*c* is separated from the side surface 1*e*. The end edge 52*d* is separated from the side surface 1*f*.

The second intermediate electrical conductor 52 has, for example, a rectangular shape when viewed from the first direction D1. The length of the second intermediate electrical conductor 52 in the second direction D2 is larger than, for example, the length of the second intermediate electrical conductor 52 in the third direction D3. A length WP3 of the second intermediate electrical conductor 52 in the second direction D2 is, for example, 0.5 to 0.7 mm. A length WP4 of the second intermediate electrical conductor 52 in the third direction D3 is, for example, 0.15 to 0.25 mm. In the present supplementary notes, the length WP1 and the length WP3 may be equal to each other, and the length WP2 and the length WP4 may be equal to each other.

The first internal electrode 31 and the first intermediate electrical conductor 51 overlap each other when viewed from the first direction D1. A first region RG1 in which the first internal electrode 31 and the first intermediate electrical conductor 51 overlap each other has a rectangular shape. The rectangular shape of the first region RG1 is defined by the end edge 51*a*, the end edge 31*b*, the end edge 51*c*, and the end edge 51*d*. The rectangular shape of the first region RG1 may be defined by the end edge 51*a*, the end edge 31*b*, the end edge 31*c*, and the end edge 31*d*.

The opposing area of the first internal electrode 31 and the first intermediate electrical conductor 51 corresponds to an area of the first region RG1, and is defined by, for example, a product of a length of the end edge 51*a* and a length of the portion defining the rectangular shape of the first region RG1 in the end edge 51*c*. The length of the end edge 51*a* coincides with the length WP2 of the first intermediate electrical conductor 51 in the third direction D3. The length of the end edge 51*a* is, for example, 0.15 to 0.25 mm. The length of the portion defining the rectangular shape of the first region RG1 in the end edge 51*c* is, for example, 0.1 to 0.3 mm. The area of the first region RG1, that is, the opposing area of the first internal electrode 31 and the first intermediate electrical conductor 51 is, for example, 0.015 to 0.075 $mm^2$. In the first direction D1, a ratio of the opposing area of the first internal electrode 31 and the first intermediate electrical conductor 51 to the area of the first intermediate electrical conductor 51 is, for example, 0.10 to 0.17.

The third internal electrode 32 and the first intermediate electrical conductor 51 overlap each other when viewed from the first direction D1. A second region RG2 in which the third internal electrode 32 and the first intermediate electrical conductor 51 overlap each other has a rectangular shape. The rectangular shape of the second region RG2 is defined by the end edge 32*a*, the end edge 51*b*, the end edge 51*c*, and the end edge 51*d*. The rectangular shape of the second region RG2 may be defined by the end edge 32*a*, the end edge 51*b*, the end edge 32*c*, and the end edge 32*d*.

The opposing area of the third internal electrode 32 and the first intermediate electrical conductor 51 corresponds to an area of the second region RG2, and is defined by, for example, a product of a length of the end edge 51*b* and a length of the portion defining the rectangular shape of the second region RG2 in the end edge 51*c*. The length of the end edge 51*b* coincides with the length WP2 of the first intermediate electrical conductor 51 in the third direction D3, and is, for example, 0.15 to 0.25 mm. The length of the portion defining the rectangular shape of the second region RG2 in the end edge 51*c* is, for example, 0.1 to 0.3 mm. The area of the second region RG2, that is, the opposing area of the third internal electrode 32 and the first intermediate electrical conductor 51 is, for example, 0.015 to 0.075 $mm^2$. In the first direction D1, a ratio of the opposing area of the third internal electrode 32 and the first intermediate electrical conductor 51 to the area of the first intermediate electrical conductor 51 is, for example, 0.10 to 0.17. The ratio of the opposing area of the third internal electrode 32 and the first intermediate electrical conductor 51 to the area of the first intermediate electrical conductor 51 may be equal to the ratio of the opposing area of the first internal electrode 31 and the first intermediate electrical conductor 51 to the area of the first intermediate electrical conductor 51.

The first internal electrode 31 and the second intermediate electrical conductor 52 overlap each other when viewed from the first direction D1. A third region RG3 in which the first internal electrode 31 and the second intermediate electrical conductor 52 overlap each other has a rectangular shape. The rectangular shape of the third region RG3 is defined by the end edge 52*a*, the end edge 31*b*, the end edge 52*c*, and the end edge 52*d*. The rectangular shape of the third region RG3 may be defined by the end edge 52*a*, the end edge 31*b*, the end edge 31*c*, and the end edge 31*d*.

The opposing area of the first internal electrode 31 and the second intermediate electrical conductor 52 corresponds to an area of the third region RG3, and is defined by, for example, a product of a length of the end edge 52*a* and a length of the portion defining the rectangular shape of the third region RG3 in the end edge 52*c*. The length of the end edge 52*a* coincides with the length WP4 of the second intermediate electrical conductor 52 in the third direction D3, and is, for example, 0.15 to 0.25 mm. The length of the portion defining the rectangular shape of the third region RG3 in the end edge 52*c* is, for example, 0.1 to 0.3 mm. The area of the third region RG3, that is, the opposing area of the first internal electrode 31 and the second intermediate electrical conductor 52 is, for example, 0.015 to 0.075 $mm^2$. In the first direction D1, a ratio of the opposing area of the first internal electrode 31 and the second intermediate electrical conductor 52 to the area of the second intermediate electrical conductor 52 is, for example, 0.10 to 0.17. The ratio of the opposing area of the first internal electrode 31 and the second intermediate electrical conductor 52 to the area of the second intermediate electrical conductor 52 may be equal to the ratio of the opposing area of the first internal electrode 31 and the first intermediate electrical conductor 51 to the area of the first intermediate electrical conductor 51. The area of the second intermediate electrical conductor 52 may be equal to the area of the first intermediate electrical conductor 51.

The third internal electrode 32 and the second intermediate electrical conductor 52 overlap each other when viewed from the first direction D1. A fourth region RG4 in which the third internal electrode 32 and the second intermediate electrical conductor 52 overlap each other has a rectangular shape. The rectangular shape of the fourth region RG4 is defined by the end edge 32*a*, the end edge 52*b*, the end edge 52*c*, and the end edge 52*d*. The rectangular shape of the fourth region RG4 may be defined by the end edge 32*a*, the end edge 52*b*, the end edge 32*c*, and the end edge 32*d*.

The opposing area of the third internal electrode 32 and the second intermediate electrical conductor 52 corresponds to an area of the fourth region RG4, and is defined by, for example, a product of a length of the end edge 52*b* and a length of the portion defining the rectangular shape of the fourth region RG4 in the end edge 52*c*. The length of the end edge 52*b* coincides with the length WP4 of the second intermediate electrical conductor 52 in the third direction D3, and is, for example, 0.15 to 0.25 mm. The length of the portion defining the rectangular shape of the fourth region RG4 in the end edge 52*c* is, for example, 0.1 to 0.3 mm. The area of the fourth region RG4, that is, the opposing area of the third internal electrode 32 and the second intermediate electrical conductor 52 is, for example, 0.015 to 0.075 $mm^2$. In the first direction D1, a ratio of the opposing area of the third internal electrode 32 and the second intermediate electrical conductor 52 to the area of the second intermediate electrical conductor 52 is, for example, 0.10 to 0.17. The ratio of the opposing area of the third internal electrode 32 and the second intermediate electrical conductor 52 to the area of the second intermediate electrical conductor 52 may be equal to the ratio of the opposing area of the first internal electrode 31 and the second intermediate electrical conductor 52 to the area of the second intermediate electrical conductor 52.

The second internal electrode 41 and the first intermediate electrical conductor 51 overlap each other when viewed from the first direction D1. A fifth region RG5 in which the second internal electrode 41 and the first intermediate electrical conductor 51 overlap each other has a rectangular shape. The rectangular shape of the fifth region RG5 is defined by the end edge 51*a*, the end edge 41*b*, the end edge 51*c*, and the end edge 51*d*. The rectangular shape of the fifth region RG5 may be defined by the end edge 51*a*, the end edge 41*b*, the end edge 41*c*, and the end edge 41*d*.

The opposing area of the second internal electrode 41 and the first intermediate electrical conductor 51 corresponds to an area of the fifth region RG5, and is defined by, for example, a product of the length of the end edge 51*a* and a length of the portion defining the rectangular shape of the fifth region RG5 in the end edge 51*c*. The length of the end edge 51*a* coincides with the length WP2 of the first intermediate electrical conductor 51 in the third direction D3, and is, for example, 0.15 to 0.25 mm. The length of the portion defining the rectangular shape of the fifth region RG5 in the end edge 51*c* is, for example, 0.1 to 0.3 mm. The area of the fifth region RG5, that is, the opposing area of the second internal electrode 41 and the first intermediate electrical conductor 51 is, for example, 0.015 to 0.075 $mm^2$. In the first direction D1, a ratio of the opposing area of the second internal electrode 41 and the first intermediate electrical conductor 51 to the area of the first intermediate electrical conductor 51 is, for example, 0.10 to 0.17. The ratio of the opposing area of the second internal electrode 41 and the first intermediate electrical conductor 51 to the area of the first intermediate electrical conductor 51 may be equal to the ratio of the opposing area of the first internal electrode 31 and the first intermediate electrical conductor 51 to the area of the first intermediate electrical conductor 51.

The fourth internal electrode 42 and the first intermediate electrical conductor 51 overlap each other when viewed from the first direction D1. A sixth region RG6 in which the fourth internal electrode 42 and the first intermediate electrical conductor 51 overlap each other has a rectangular shape. The rectangular shape of the sixth region RG6 is defined by the end edge 42*a*, the end edge 51*b*, the end edge 51*c*, and the end edge 51*d*. The rectangular shape of the fourth region RG4 may be defined by the end edge 42*a*, the end edge 51*b*, the end edge 42*c*, and the end edge 42*d*.

The opposing area of the fourth internal electrode 42 and the first intermediate electrical conductor 51 corresponds to an area of the sixth region RG6, and is defined by, for example, a product of the length of the end edge 51*b* and a length of the portion defining the rectangular shape of the sixth region RG6 in the end edge 51*c*. The length of the end edge 51*b* coincides with the length WP2 of the first intermediate electrical conductor 51 in the third direction D3, and is, for example, 0.15 to 0.25 mm. The length of the portion defining the rectangular shape of the sixth region RG6 in the end edge 51*c* is, for example, 0.1 to 0.3 mm. The area of the sixth region RG6, that is, the opposing area of the fourth internal electrode 42 and the first intermediate electrical conductor 51 is, for example, 0.015 to 0.075 $mm^2$. In the first direction D1, a ratio of the opposing area of the fourth internal electrode 42 and the first intermediate electrical conductor 51 to the area of the first intermediate electrical conductor 51 is, for example, 0.10 to 0.17. The ratio of the opposing area of the fourth internal electrode 42 and the first intermediate electrical conductor 51 to the area of the first intermediate electrical conductor 51 may be equal to the ratio of the opposing area of the second internal electrode 41 and the first intermediate electrical conductor 51 to the area of the first intermediate electrical conductor 51.

In the multilayer chip varistor EC2, the intermediate electrical conductor group EG3 includes a third intermediate electrical conductor 53. The third intermediate electrical conductor 53 is separated from the second internal electrode 41 and the fourth internal electrode 42 in the first direction D1. The third intermediate electrical conductor 53 is opposed to the first intermediate electrical conductor 51 in a state where the second and fourth internal electrodes 41 and 42 are located between the first and third intermediate electrical conductors 51 and 53. In the present supplementary notes, the third intermediate electrical conductor 53 is positioned, for example, between the second and fourth internal electrodes 41 and 42 and the principal surface 1*b* in the first direction D1. The third intermediate electrical conductor 53 is opposed to the second internal electrode 41 and the fourth internal electrode 42 in the first direction D1.

The third intermediate electrical conductor 53 includes a pair of end edges 53*a* and 53*b*. The pair of end edges 53*a* and 53*b* define both ends of the third intermediate electrical conductor 53 in the second direction D2. The end edge 53*a* is separated from the end surface 1*c*. The end edge 53*a* is separated from the first external electrode 10. In the second direction D2, the end edge 53*b* is separated from the end surface 1*d*. The end edge 53*b* is separated from the second external electrode 20. The third intermediate electrical conductor 53 is not connected to the first and second external electrodes 10 and 20. The third intermediate electrical conductor 53 includes a pair of end edges 53*c* and 53*d*. The pair of end edges 53*c* and 53*d* define both ends of the third intermediate electrical conductor 53 in the third direction D3. The end edge 53*c* is separated from the side surface 1*e*. The end edge 53*d* is separated from the side surface 1*f*.

The third intermediate electrical conductor 53 has, for example, a rectangular shape when viewed from the first direction D1. The length of the third intermediate electrical conductor 53 in the second direction D2 is larger than, for example, the length of the third intermediate electrical conductor 53 in the third direction D3. A length WP5 of the third intermediate electrical conductor 53 in the second direction D2 is, for example, 0.5 to 0.7 mm. A length WP6 of the third intermediate electrical conductor 53 in the third direction D3 is, for example, 0.15 to 0.25 mm. The length WP5 may be equal to at least one of the length WP1 and the length WP3. The length WP6 may be equal to at least one of the length WP2 and the length WP4.

The second internal electrode 41 and the third intermediate electrical conductor 53 overlap each other when viewed from the first direction D1. A seventh region RG7 in which the second internal electrode 41 and the third intermediate electrical conductor 53 overlap each other has a rectangular shape when viewed from the first direction D1.

The rectangular shape of the seventh region RG7 is defined by the end edge 53*a*, the end edge 41*b*, the end edge 53*c*, and the end edge 53*d*. The rectangular shape of the seventh region RG7 may be defined by the end edge 53*a*, the end edge 41*b*, the end edge 41*c*, and the end edge 41*d*.

The opposing area of the second internal electrode 41 and the third intermediate electrical conductor 53 corresponds to an area of the seventh region RG7, and is defined by, for example, a product of a length of the end edge 53*a* and a length of the portion defining the rectangular shape of the seventh region RG7 in the end edge 53*c*. The length of the end edge 53*a* coincides with the length WP6 of the third intermediate electrical conductor 53 in the third direction D3. The length of the end edge 53*a* is, for example, 0.15 to 0.25 mm. The length of the portion defining the rectangular shape of the seventh region RG7 in the end edge 53*c* is, for example, 0.1 to 0.3 mm. The area of the seventh region RG7, that is, the opposing area of the second internal electrode 41 and the third intermediate electrical conductor 53 is, for example, 0.015 to 0.075 $mm^2$ In the first direction D1, a ratio of the opposing area of the second internal electrode 41 and the third intermediate electrical conductor 53 to the area of the third intermediate electrical conductor 53 is, for example, 0.10 to 0.17. The ratio of the opposing area of the second internal electrode 41 and the third intermediate electrical conductor 53 to the area of the third intermediate electrical conductor 53 may be equal to the ratio of the opposing area of the second internal electrode 41 and the first intermediate electrical conductor 51 to the area of the first intermediate electrical conductor 51. The area of the third intermediate electrical conductor 53 may be equal to the area of the first intermediate electrical conductor 51.

The fourth internal electrode 42 and the third intermediate electrical conductor 53 overlap each other when viewed from the first direction D1. An eighth region RG8 in which the fourth internal electrode 42 and the third intermediate electrical conductor 53 overlap each other has a rectangular shape. The rectangular shape of the eighth region RG8 is defined by the end edge 42*a*, the end edge 53*b*, the end edge 53*c*, and the end edge 53*d*. The rectangular shape of the eighth region RG8 may be defined by the end edge 42*a*, the end edge 53*b*, the end edge 42*c*, and the end edge 42*d*.

The opposing area of the fourth internal electrode 42 and the third intermediate electrical conductor 53 corresponds to an area of the eighth region RG8, and is defined by, for example, a product of a length of the end edge 53*b* and a length of the portion defining the rectangular shape of the eighth region RG8 in the end edge 53*c*. The length of the end edge 53*b* coincides with the length WP6 of the third intermediate electrical conductor 53 in the third direction D3, and is, for example, 0.15 to 0.25 mm. A length of the portion defining the rectangular shape of the eighth region RG8 in the end edge 53*c* is, for example, 0.1 to 0.3 mm. The area of the eighth region RG8, that is, the opposing area of the fourth internal electrode 42 and the third intermediate electrical conductor 53 is, for example, 0.015 to 0.075 $mm^2$. In the first direction D1, a ratio of the opposing area of the fourth internal electrode 42 and the third intermediate electrical conductor 53 to the area of the third intermediate electrical conductor 53 is, for example, 0.10 to 0.17. In the present supplementary notes, the ratio of the opposing area of the fourth internal electrode 42 and the third intermediate electrical conductor 53 to the area of the third intermediate electrical conductor 53 may be equal to the ratio of the opposing area of the second internal electrode 41 and the third intermediate electrical conductor 53 to the area of the third intermediate electrical conductor 53.

In the present supplementary notes, the second intermediate electrical conductor 52, the first and third internal electrodes 31 and 32, the first intermediate electrical conductor 51, the second and fourth internal electrodes 41 and 42, and the third intermediate electrical conductor 53 are arranged in this order in the first direction D1 when viewed from the second direction D2. The second intermediate electrical conductor 52 is separated from the first and third internal electrodes 31 and 32 in the first direction D1. An interval SD1 between the second intermediate electrical conductor 52 and the first and third internal electrodes 31 and 32 in the first direction D1 is, for example, larger than 0 mm and 0.08 mm or less. The first and third internal electrodes 31 and 32 are separated from the first intermediate electrical conductor 51 in the first direction D1. An interval SD2 between the first and third internal electrodes 31 and 32 and the first intermediate electrical conductor 51 in the first direction D1 is, for example, larger than 0 mm and 0.08 mm or less. The first intermediate electrical conductor 51 is separated from the second and fourth internal electrodes 41 and 42 in the first direction D1. An interval SD3 between the first intermediate electrical conductor 51 and the second and fourth internal electrodes 41 and 42 in the first direction D1 is, for example, larger than 0 mm and 0.08 mm or less. The second and fourth internal electrodes 41 and 42 are separated from the third intermediate electrical conductor 53 in the first direction D1. An interval SD4 between the second and fourth internal electrodes 41 and 42 and the second and third intermediate electrical conductors 53 in the first direction D1 is, for example, larger than 0 mm and 0.08 mm or less. The interval SD1, the interval SD2, the interval SD3, and the interval SD4 may be equal to each other. The second intermediate electrical conductor 52 is separated from the principal surface 1*a* in the first direction D1. The interval between the second intermediate electrical conductor 52 and the principal surface 1*a* in the first direction D1 is, for example, larger than 0 mm and 0.2 mm or less. The third intermediate electrical conductor 53 is separated from the principal surface 1*b* in the first direction D1. The interval between the third intermediate electrical conductor 53 and the principal surface 1*b* in the first direction D1 is, for example, larger than 0 mm and 0.2 mm or less. The interval between the second intermediate electrical conductor 52 and the principal surface 1*a* and the interval between the third intermediate electrical conductor 53 and the principal surface 1*b* may be larger than any of the interval SD1, the interval SD2, the interval SD3, and the interval SD4.

The end edge 31*b* and the end edge 32*a* are separated from each other in the second direction D2. An interval SE1 between the end edge 31*b* and the end edge 32*a* is, for example, larger than 0.005 mm and 0.16 mm or less. The end edge 41*b* and the end edge 42*a* are separated from each other in the second direction D2. An interval SE2 between the end edge 41*b* and the end edge 42*a* is, for example, larger than 0.005 mm and 0.16 mm or less. The interval SE1 and the interval SE2 may be equal to each other. In the present supplementary notes, the length WP1 of the first intermediate electrical conductor 51 in the second direction D2 is larger than the interval SE1 and the interval SE2. The length WP3 of the second intermediate electrical conductor 52 in the second direction D2 is larger than the interval SE1. The length WP5 of the third intermediate electrical conductor 53 in the second direction D2 is larger than the interval SE2.

The thicknesses of the first and third internal electrodes 31 and 32 and the thicknesses of the second and fourth internal electrodes 41 and 42 are, for example, 5 μm. The thicknesses of the first and third internal electrodes 31 and 32 and the thicknesses of the second and fourth internal electrodes 41 and 42 may be equal to each other. The thicknesses of the first, second, and third intermediate electrical conductors 51, 52, and 53 are, for example, 5 μm. The thicknesses of the first, second, and third intermediate electrical conductors 51, 52, and 53 may be equal to each other.

The first, second, and third intermediate electrical conductors 51, 52, and 53 include, for example, the first electrically conductive material. The first intermediate electrical conductor 51 includes the second electrically conductive material different from the first electrically conductive material. The second intermediate electrical conductor 52 may include the second electrically conductive material. The third intermediate electrical conductor 53 may include the second electrically conductive material. The second electrically conductive material includes an electrically conductive material having a low electrical resistance, for example, Al. The second electrically conductive material may include, for example, Ga or In. The first, second, and third intermediate electrical conductors 51, 52, and 53 are each configured as a sintered body of a conductive paste including the first electrically conductive material and the second electrically conductive material. In the present supplementary notes, the first, second, and third intermediate electrical conductors 51, 52, and 53 mainly include the first electrically conductive material, and the first electrically conductive material included in the first, second, and third intermediate electrical conductors 51, 52, and 53 includes Pd.

The content of the second electrically conductive material in the first intermediate electrical conductor 51 is, for example, larger than 0 atomic % (atm %) and 5 atomic % or less. The content of the second electrically conductive material in the first intermediate electrical conductor 51 may be, for example, 0.1 atomic % or more and 3 atomic % or less. The content of the second electrically conductive material in the second intermediate electrical conductor 52 is, for example, larger than 0 atomic % and 5 atomic % or less. The content of the second electrically conductive material in the second intermediate electrical conductor 52 may be, for example, 0.1 atomic % or more and 3 atomic % or less. The content of the second electrically conductive material in the third intermediate electrical conductor 53 is, for example, larger than 0 atomic % and 5 atomic % or less. The content of the second electrically conductive material in the third intermediate electrical conductor 53 may be, for example, 0.1 atomic % or more and 3 atomic % or less. In the present supplementary notes, the contents of the second electrically conductive material in the first, second, and third intermediate electrical conductors 51, 52, and 53 may be equal to each other.

The element body 1 includes a first element body region S1 between the first internal electrode 31 and the first intermediate electrical conductor 51 in the first region RG1, and a second element body region S2 between the third internal electrode 32 and the first intermediate electrical conductor 51 in the second region RG2. A bottom surface of the first element body region S1 is defined by the first region RG1, and a height of the first element body region S1 is defined by the interval SD2 between the first and third internal electrodes 31 and 32 and the first intermediate electrical conductor 51. A bottom surface of the first element body region S2 is defined by the second region RG2, and a height of the first element body region S2 is defined by the interval SD2.

The first intermediate electrical conductor 51 is configured as, for example, a sintered body of a conductive paste including the second electrically conductive material. In the first and second element body regions S1 and S2, the second electrically conductive material different from the first electrically conductive material is diffused. A region surrounding each of the first and second element body regions S1 and S2 includes a portion where the second electrically conductive material is not diffused. In the region in which the second electrically conductive material is diffused, the electrical resistance of the region is reduced. The element body 1 includes a low electrical resistance region which is positioned between the first and third internal electrodes 31 and 32 and the first intermediate electrical conductor 51, and in which the second electrically conductive material is diffused.

The element body 1 includes a third element body region S3 between the first internal electrode 31 and the second intermediate electrical conductor 52 in the third region RG3, and a fourth element body region S4 between the third internal electrode 32 and the second intermediate electrical conductor 52 in the fourth region RG4. A bottom surface of the third element body region S3 is defined by the third region RG3, and a height of the third element body region S3 is defined by the interval SD1 between the first and third internal electrodes 31 and 32 and the second intermediate electrical conductor 52. A bottom surface of the fourth element body region S4 is defined by the fourth region RG4, and a height of the fourth element body region S4 is defined by the interval SD1.

The second intermediate electrical conductor 52 is configured as, for example, a sintered body of a conductive paste including the second electrically conductive material. In the third and fourth element body regions S3 and S4, the second electrically conductive material different from the first electrically conductive material is diffused. A region surrounding each of the third and fourth element body regions S3 and S4 includes a portion where the second electrically conductive material is not diffused. In the region in which the second electrically conductive material is diffused, the electrical resistance of the region is reduced. The element body 1 includes a low electrical resistance region which is positioned between the first and third internal electrodes 31 and 32 and the second intermediate electrical conductor 52, and in which the second electrically conductive material is diffused.

The element body 1 includes a fifth element body region S5 between the second internal electrode 41 and the first intermediate electrical conductor 51 in the fifth region RG5, and a sixth element body region S6 between the fourth internal electrode 42 and the first intermediate electrical conductor 51 in the sixth region RG6. A bottom surface of the fifth element body region S5 is defined by the fifth region RG5, and a height of the fifth element body region S5 is defined by the interval SD3 between the second and fourth internal electrodes 41 and 42 and the first intermediate electrical conductor 51. A bottom surface of the sixth element body region S6 is defined by the sixth region RG6, and a height of the sixth element body region S6 is defined by the interval SD3.

The first intermediate electrical conductor 51 is configured as, for example, a sintered body of a conductive paste including the second electrically conductive material. The second electrically conductive material is diffused in the fifth and sixth element body regions S5 and S6. A region surrounding each of the fifth and sixth element body regions S5 and S6 includes a portion where the second electrically conductive material is not diffused. In the region in which the second electrically conductive material is diffused, the electrical resistance of the region is reduced. The element body 1 includes a low electrical resistance region which is positioned between the second and fourth internal electrodes 41 and 42 and the first intermediate electrical conductor 51, and in which the second electrically conductive material is diffused.

In a case where the third intermediate electrical conductor 53 is disposed, the element body 1 includes a seventh element body region S7 between the second internal electrode 41 and the third intermediate electrical conductor 53 in the seventh region RG7, and an eighth element body region S8 between the fourth internal electrode 42 and the third intermediate electrical conductor 53 in the eighth region RG8. A bottom surface of the seventh element body region S7 is defined by the seventh region RG7, and a height of the seventh element body region S7 is defined by the distance SD4 between the second and fourth internal electrodes 41 and 42 and the third intermediate electrical conductor 53. A bottom surface of the eighth element body region S8 is defined by the eighth region RG8, and a height of the eighth element body region S8 is defined by the interval SD4.

The third intermediate electrical conductor 53 is configured as, for example, a sintered body of a conductive paste including the second electrically conductive material. The second electrically conductive material is diffused in the seventh and eighth element body regions S7 and S8. A region surrounding each of the seventh and eighth element body regions S7 and S8 includes a portion where the second electrically conductive material is not diffused. In the region in which the second electrically conductive material is diffused, the electrical resistance of the region is reduced. The element body 1 includes a low electrical resistance region which is positioned between the second and fourth internal electrodes 41 and 42 and the third intermediate electrical conductor 53, and in which the second electrically conductive material is diffused.

In the present supplementary notes, in addition to the first, second, and third intermediate electrical conductors 51, 52, and 53, the first and third internal electrodes 31 and 32 and the second and fourth internal electrodes 41 and 42 may include the second electrically conductive material having a low electrical resistance in addition to the first electrically conductive material. The content of the second electrically conductive material in the first and third internal electrodes 31 and 32 and the second and fourth internal electrodes 41 and 42 is, for example, 0 atomic % (atm %) or more and 0.5 atomic % or less. The content of the second electrically conductive material in the first and third internal electrodes 31 and 32 and the second and fourth internal electrodes 41 and 42 may be, for example, larger than 0.1 atomic % and 0.3 atomic % or less. In a case where the first and third internal electrodes 31 and 32 and the second and fourth internal electrodes 41 and 42 include the second electrically conductive material in addition to the first electrically conductive material, the content of the second electrically conductive material in the first, second, and third intermediate electrical conductors 51, 52, and 53 may be equal to or larger than the content of the second electrically conductive material in each of the first and third internal electrodes 31 and 32 and the second and fourth internal electrodes 41 and 42.

The effect of the multilayer chip varistor EC2 according to the supplementary notes will be described. The multilayer chip varistor EC2 includes the element body 1 exhibiting varistor characteristics, the first external electrode 10 and the second external electrode 20 disposed at both ends of the element body 1, the first internal electrode group EG1 disposed closer to one end in the element body 1, the second internal electrode group EG2 disposed closer to another end in the element body 1, and the intermediate electrical conductor group EG3 disposed in a mid-region of the element body 1. The first internal electrode group EG1 includes the first internal electrode 31 and the second internal electrode 41, the first and second internal electrodes 31 and 41 including the first electrically conductive material, being connected to the first external electrode 10, and opposed to each other. The second internal electrode group EG2 includes the third internal electrode 32 and the fourth internal electrode 42, the third and fourth internal electrodes 32 and 42 including the first electrically conductive material, being connected to the second external electrode 20, and opposed to each other. The intermediate electrical conductor group EG3 includes the first intermediate electrical conductor not connected to the first external electrode 10 and the second external electrode 20, and opposed to the first internal electrode 31, the second internal electrode, the third internal electrode, and the fourth internal electrode, and the second intermediate electrical conductor 52 not connected to the first external electrode 10 and the second external electrode 20, and opposed to the first intermediate electrical conductor 51 in a state where the first and third internal electrodes 31 and 32 are located between the first and second intermediate electrical conductors 51 and 52. The first intermediate electrical conductor 51 includes the second electrically conductive material different from the first electrically conductive material. The element body 1 includes a low electrical resistance region between the first, second, third, and fourth internal electrodes 31, 41, 32, and 42 and the first intermediate electrical conductor 51, and the second electrically conductive material included in the first intermediate electrical conductor 51 is diffused in the low electrical resistance region.

In the present supplementary notes, the element body 1 includes a region in which the second electrically conductive material included in the first intermediate electrical conductor 51 is diffused between the first, second, third, and fourth internal electrodes 31, 41, 32, and 42 and the first intermediate electrical conductor 51. The region in which the second electrically conductive material is diffused has a lower electrical resistance than the region in which the second electrically conductive material is not diffused. The multilayer chip varistor EC2 has the improved ESD tolerance.

In the multilayer chip varistor EC2, the ratio of the opposing area of the first internal electrode 31 and the first intermediate electrical conductor 51 to the area of the first intermediate electrical conductor 51 is 0.10 to 0.17. The ratio of the opposing area of the second internal electrode 41 and the first intermediate electrical conductor 51 to the area of the first intermediate electrical conductor 51 is 0.10 to 0.17. The ratio of the opposing area of the third internal electrode 32 and the first intermediate electrical conductor 51 to the area of the first intermediate electrical conductor 51 is 0.10 to 0.17. The ratio of the opposing area of the fourth internal electrode 42 and the first intermediate electrical conductor 51 to the area of the first intermediate electrical conductor 51 is 0.10 to 0.17.

Therefore, the second electrically conductive material is surely diffused in the region positioned between the first, second, third, and fourth internal electrodes 31, 41, 32, and 42 and the first intermediate electrical conductor 51. As a result, the multilayer chip varistor EC2 surely has the improved ESD tolerance.

In the multilayer chip varistor EC2, the second intermediate electrical conductor 52 includes the second electrically conductive material, and the element body 1 includes a low electrical resistance region between the first internal electrode 31 and the third internal electrode 32, and the second intermediate electrical conductor 52, and the second electrically conductive material included in the second intermediate electrical conductor 52 is diffused in the low electrical resistance region.

Therefore, the element body 1 includes a region in which the second electrically conductive material included in the second intermediate electrical conductor 52 is diffused between the first internal electrode 31 and the third internal electrode 32, and the second intermediate electrical conductor 52. The region in which the second electrically conductive material is diffused has a lower electrical resistance than the region in which the second electrically conductive material is not diffused. The multilayer chip varistor EC2 has the further improved ESD tolerance.

In the multilayer chip varistor EC2, the ratio of the opposing area of the first internal electrode 31 and the second intermediate electrical conductor 52 to the area of the second intermediate electrical conductor 52 is 0.10 to 0.17. The ratio of the opposing area of the third internal electrode 32 and the second intermediate electrical conductor 52 to the area of the second intermediate electrical conductor 52 is 0.10 to 0.17. Therefore, the second electrically conductive material is surely diffused in the region between the first and third internal electrodes 31 and 32 and the second intermediate electrical conductor 52. As a result, the multilayer chip varistor EC2 surely has the improved ESD tolerance.

In the multilayer chip varistor EC2, the first, second, third, and fourth internal electrodes 31, 41, 32, and 42 include the second electrically conductive material.

Therefore, the second electrically conductive material is diffused from the first, second, third, and fourth internal electrodes 31, 41, 32, and 42 to the region between the first, second, third, and fourth internal electrodes 31, 41, 32, and 42 and the first intermediate electrical conductor 51. As a result, the multilayer chip varistor EC2 surely has the improved ESD tolerance.

In the multilayer chip varistor EC2, the content of the second electrically conductive material in the first intermediate electrical conductor 51 is equal to or larger than the content of the second electrically conductive material in each of the first, second, third, and fourth internal electrodes 31, 41, 32, and 42.

Therefore, the second electrically conductive material is more surely diffused from the first intermediate electrical conductor 51 to the region between the first, second, third, and fourth internal electrodes 31, 41, 32, and 42 and the first intermediate electrical conductor 51. As a result, the multilayer chip varistor EC2 surely has the more improved ESD tolerance.

In the multilayer chip varistor EC2, the content of the second electrically conductive material in the second intermediate electrical conductor 52 is equal to or larger than the content of the second electrically conductive material in each of the first and third internal electrodes 31 and 32.

Therefore, the second electrically conductive material is more surely diffused from the second intermediate electrical conductor 52 to the region between the first and third internal electrodes 31 and 32 and the second intermediate electrical conductor 52. As a result, the multilayer chip varistor EC2 surely has the more improved ESD tolerance.

In the multilayer chip varistor EC2, the intermediate electrical conductor group EG3 includes the third intermediate electrical conductor 53 not connected to the first external electrode 10 and the second external electrode 20, and opposed to the first intermediate electrical conductor 51 in a state where the second and fourth internal electrodes 41 and 42 are located between the first and third intermediate electrical conductors 51 and 53. The third intermediate electrical conductor 53 includes the second electrically conductive material. The element body 1 includes a low electrical resistance region between the second internal electrode 41 and the fourth internal electrode 42, and the third intermediate electrical conductor 53, and the second electrically conductive material included in the third intermediate electrical conductor 53 is diffused in the low electrical resistance region.

Therefore, the element body 1 includes a region in which the second electrically conductive material included in the third intermediate electrical conductor 53 is diffused between the second and fourth internal electrodes 41 and 42 and the third intermediate electrical conductor 53. The region in which the second electrically conductive material is diffused has a lower electrical resistance than the region in which the second electrically conductive material is not diffused. The multilayer chip varistor EC2 has the further improved ESD tolerance.

In the multilayer chip varistor EC2, the ratio of the opposing area of the second internal electrode 41 and the third intermediate electrical conductor 53 to the area of the third intermediate electrical conductor 53 is 0.10 to 0.17. The ratio of the opposing area of the fourth internal electrode 42 and the third intermediate electrical conductor 53 to the area of the third intermediate electrical conductor 53 is 0.10 to 0.17.

Therefore, the second electrically conductive material is surely diffused in the region between the second and fourth internal electrodes 41 and 42 and the third intermediate electrical conductor 53. As a result, the multilayer chip varistor EC2 surely has the more improved ESD tolerance.

In the multilayer chip varistor EC2, the intermediate electrical conductor group EG3 may include the first intermediate electrical conductor 51 and the second intermediate electrical conductor 52 as described above, or may include the first intermediate electrical conductor 51, the second intermediate electrical conductor 52, and the third intermediate electrical conductor 53. In the multilayer chip varistor EC2, the intermediate electrical conductor group EG3 may include the first intermediate electrical conductor 51 and the third intermediate electrical conductor 53. In the configuration in which the intermediate electrical conductor group EG3 includes the first intermediate electrical conductor 51 and the third intermediate electrical conductor 53, the multilayer chip varistor EC2 surely has the improved ESD tolerance.

Subsequently, the multilayer chip varistor EC2 will be described with reference to Reference Examples 1 to 15 according to the present supplementary notes. The shape and size of the element body 1 in Reference Examples 1 to 15 below are the same as the shape and size of the element body 1 of Example 1 described above. The invention according to the present supplementary notes is not limited to the following examples.

Reference Example 1

A configuration of the multilayer chip varistor EC2 according to Reference Example 1 is as follows.

In Reference Example 1, in the multilayer chip varistor EC2, the first and third internal electrodes 31 and 32, the first and second intermediate electrical conductors 51 and 52, and the second and fourth internal electrodes 41 and 42 are disposed in the element body 1. The interval SD1, the interval SD2, the interval SD3, and the interval SD4 are 0.060 mm. An interval between the second intermediate electrical conductor 52 and the principal surface 1*a* and an interval between the third intermediate electrical conductor 53 and the principal surface 1*b* are 0.150 mm. The interval SD1, the interval SD2, the interval SD3, and the interval SD4 are the same as each other. In Reference Example 2 to Reference Example 14 and Reference Example 15 below, the interval SD1, the interval SD2, the interval SD3, and the interval SD4 are the same as each other.

The first and third internal electrodes 31 and 32 and the second and fourth internal electrodes 41 and 42 have rectangular shapes when viewed from the first direction D1. The lengths WK1, WK3, WK5, and WK7 of the internal electrodes 31, 32, 41, and 42 in the second direction D2 are 0.4325 mm. The lengths WK2, WK4, WK6, and WK8 of the internal electrodes 31, 32, 41, and 42 in the third direction D3 are 0.2 mm. The areas of the internal electrodes 31, 32, 41, and 42 when viewed from the first direction D1 are 0.0865 $mm^2$.

The first and second intermediate electrical conductors 51 and 52 have a rectangular shape when viewed from the first direction D1. The lengths WP1 and WP3 of the first and second intermediate electrical conductors 51 and 52 in the second direction D2 are 0.63 mm. The lengths WP2 and WP4 of the first and second intermediate electrical conductors 51 and 52 in the third direction D3 are 0.2 mm. The areas of the first and second intermediate electrical conductors 51 and 52 when viewed from the first direction D1 are 0.126 $mm^2$.

The lengths of the first region RG1 to the sixth region RG6 in the second direction D2 are 0.104 mm. The lengths of the first region RG1 to the sixth region RG6 in the third direction D3 are 0.2 mm. The areas of the first region RG1 to the sixth region RG6 are 0.0208 $mm^2$. In the first region RG1 to the sixth region RG6, in the first direction D1, the ratio of the areas of the first region RG1 to the sixth region RG6 to the areas of the first and second intermediate electrical conductors 51 and 52, that is, the ratio of the opposing areas is 0.17. The opposing area of Reference Example 1 is a ratio of an area of one opposing region of the first region RG1 to the sixth region RG6 to an area of one intermediate electrical conductor of the first and second intermediate electrical conductors 51 and 52. The opposing area of Reference Example 1 corresponds to, for example, the ratio of the area of the first region RG1 to the area of the first intermediate electrical conductor 51 when viewed from the first direction D1.

In Reference Example 1, the content of Al in the internal electrodes 31, 32, 41, and 42 is 0 atomic %, and the content of Al in the first and second intermediate electrical conductors 51 and 52 is 0.1 atomic %. In Reference Example 1, an ESD tolerance test, an energy resistance test, a leakage current test, and a dynamic resistance test are performed in the same manner as in Example 1 described above.

Reference Example 2

In Reference Example 2, the multilayer chip varistor EC2 is prepared and tested in the same manner as in Reference Example 1 except that the content of Al in the first and second intermediate electrical conductors 51 and 52 is 0.5 atomic %.

Reference Example 3

In Reference Example 3, the multilayer chip varistor EC2 is prepared and tested in the same manner as in Reference Example 1 except that the content of Al in the first and second intermediate electrical conductors 51 and 52 is 1 atomic %.

Reference Example 4

In Reference Example 4, the multilayer chip varistor EC2 is prepared and tested in the same manner as in Reference Example 1 except that the content of Al in the first and second intermediate electrical conductors 51 and 52 is 3 atomic %.

Reference Example 5

In Reference Example 5, the multilayer chip varistor EC2 is prepared and tested in the same manner as in Reference Example 1 except that the content of Al in the first and second intermediate electrical conductors 51 and 52 is 5 atomic %.

Reference Example 6

In Reference Example 6, the multilayer chip varistor EC2 is prepared and tested in the same manner as in Reference Example 1 except that the third intermediate electrical conductor 53 is disposed in addition to the first and second intermediate electrical conductors 51 and 52. The content of Al in the first, second, and third intermediate electrical conductors 51, 52, and 53 is 0.1 atomic %. The lengths of the seventh region RG7 and the eighth region RG8 in the second direction D2 are 0.104 mm, and the lengths of the seventh region RG7 and the eighth region RG8 in the third direction D3 are 0.2 mm. The areas of the seventh region RG7 and the eighth region RG8 are 0.0208 $mm^2$. In the first region RG1 to the eighth region RG8, in the first direction D1, the ratio of the areas of the first region RG1 to the eighth region RG8 to the areas of the intermediate electrical conductors 51, 52, and 53, that is, the ratio of the opposing areas is 0.17.

Reference Example 7

In Reference Example 7, the multilayer chip varistor EC2 is prepared and tested in the same manner as in Reference Example 1 except that the third intermediate electrical conductor 53 is disposed in addition to the first and second intermediate electrical conductors 51 and 52, and the content of Al in the first, second, and third intermediate electrical conductors 51, 52, and 53 is 0.5 atomic %. In the first direction D1, the ratio of the areas of the first region RG1 to the eighth region RG8 to the areas of the intermediate electrical conductors 51, 52, and 53, that is, the ratio of the opposing areas is 0.17.

Reference Example 8

In Reference Example 8, the multilayer chip varistor EC2 is prepared and tested in the same manner as in Reference Example 1 except that the third intermediate electrical conductor 53 is disposed in addition to the first and second intermediate electrical conductors 51 and 52, and the content of Al in the first, second, and third intermediate electrical conductors 51, 52, and 53 is 1 atomic %. In the first direction D1, the ratio of the areas of the first region RG1 to the eighth region RG8 to the areas of the intermediate electrical conductors 51, 52, and 53, that is, the ratio of the opposing areas is 0.17.

Reference Example 9

In Reference Example 9, the multilayer chip varistor EC2 is prepared and tested in the same manner as in Reference Example 1 except that the third intermediate electrical conductor 53 is disposed in addition to the first and second intermediate electrical conductors 51 and 52, and the content of Al in the first, second, and third intermediate electrical conductors 51, 52, and 53 is 3 atomic %. In the first direction D1, the ratio of the areas of the first region RG1 to the eighth region RG8 to the areas of the intermediate electrical conductors 51, 52, and 53, that is, the ratio of the opposing areas is 0.17.

Reference Example 10

In Reference Example 10, the multilayer chip varistor EC2 is prepared and tested in the same manner as in Reference Example 1 except that the third intermediate electrical conductor 53 is disposed in addition to the first and second intermediate electrical conductors 51 and 52, and the content of Al in the first, second, and third intermediate electrical conductors 51, 52, and 53 is 5 atomic %. In the first direction D1, the ratio of the areas of the first region RG1 to the eighth region RG8 to the areas of the intermediate electrical conductors 51, 52, and 53, that is, the ratio of the opposing areas is 0.17.

Reference Example 11

In Reference Example 11, the multilayer chip varistor EC2 is prepared and tested in the same manner as in Reference Example 1 except that the lengths of the first region RG1 to the sixth region RG6 in the second direction D2 are smaller than those in Reference Example 1 by 41 μm, the ratio of the opposing area is 0.10, and the content of Al in the second intermediate electrical conductor 52 is 0.5 atomic %.

Reference Example 12

In Reference Example 12, the multilayer chip varistor EC2 is prepared and tested in the same manner as in Reference Example 1 except that the lengths of the first region RG1 to the eighth region RG8 in the second direction D2 are smaller than those in Reference Example 1 by 41 μm, the ratio of the opposing area is 0.10, the third intermediate electrical conductor 53 is disposed in addition to the first and second intermediate electrical conductors 51 and 52, and the content of Al in the second intermediate electrical conductor 52 is 0.5 atomic %.

Reference Example 13

In Reference Example 13, the multilayer chip varistor EC2 is prepared and tested in the same manner as in Reference Example 1 except that the content of Al in the internal electrodes 31, 32, 41, and 42 is 0.5 atomic %, and the content of Al in the first and second intermediate electrical conductors 51 and 52 is 1 atomic %.

Reference Example 14

In Reference Example 14, the multilayer chip varistor EC2 is prepared and tested in the same manner as in Reference Example 1 except that the content of Al in the internal electrodes 31, 32, 41, and 42 is 0.5 atomic %, and the content of Al in the first and second intermediate electrical conductors 51 and 52 is 0.5 atomic %.

Reference Example 15

In Reference Example 15, the multilayer chip varistor EC2 is prepared and tested in the same manner as in Reference Example 1 except that the third intermediate electrical conductor 53 is disposed in addition to the first and second intermediate electrical conductors 51 and 52, the content of Al in the internal electrodes 31, 32, 41, and 42 is 0.5 atomic %, and the content of Al in the first, second, and third intermediate electrical conductors 51, 52, and 53 is 1 atomic %. In the first direction D1, the ratio of the areas of the first region RG1 to the eighth region RG8 to the areas of the intermediate electrical conductors 51, 52, and 53, that is, the ratio of the opposing areas is 0.17.

Reference Example 16

In Reference Example 16, the multilayer chip varistor EC2 is prepared and tested in the same manner as in Reference Example 1 except that the third intermediate electrical conductor 53 is disposed in addition to the first and second intermediate electrical conductors 51 and 52, the content of Al in the internal electrodes 31, 32, 41, and 42 is 0.5 atomic %, and the content of Al in the first, second, and third intermediate electrical conductors 51, 52, and 53 is 0.5 atomic %. In the first direction D1, the ratio of the areas of the first region RG1 to the eighth region RG8 to the areas of the intermediate electrical conductors 51, 52, and 53, that is, the ratio of the opposing areas is 0.17.

Reference Example 17

In Reference Example 17, the multilayer chip varistor is prepared and tested in the same manner as in Reference Example 1 except that only the first intermediate electrical conductor 51 is disposed between the first and third internal electrodes 31 and 32 and the second and fourth internal electrodes 41 and 42, and the content of Al in the first intermediate electrical conductor 51 is 0.5 atomic %.

Reference Example 18

In Reference Example 18, the multilayer chip varistor is prepared and tested in the same manner as in Reference Example 1 except that the lengths of the first region RG1 to the sixth region RG6 in the second direction D2 are smaller than those in Reference Example 1 by −22 μm, the ratio of the opposing area is 0.20, and the content of Al in the first and second intermediate electrical conductors 51 and 52 is 0 atomic %. The notation that the lengths of the first region RG1 to the sixth region RG6 are smaller by −22 μm indicates that the lengths of the first region RG1 to the sixth region RG6 in the second direction D2 are larger by 22 μm than those in Reference Example 1.

Reference Example 19

In Reference Example 19, the multilayer chip varistor is prepared and tested in the same manner as in Reference Example 1 except that the content of Al in the first and second intermediate electrical conductors 51 and 52 is 0 atomic %.

Reference Example 20

In Reference Example 20, the multilayer chip varistor is prepared and tested in the same manner as in Reference Example 1 except that the lengths of the first region RG1 to the sixth region RG6 in the second direction D2 are smaller than those in Reference Example 1 by 41 μm, the ratio of the opposing area is 0.10, and the content of Al in the first and second intermediate electrical conductors 51 and 52 is 0 atomic %.

Reference Example 21

In Reference Example 21, the multilayer chip varistor is prepared and tested in the same manner as in Reference Example 1 except that the lengths of the first region RG1 to the sixth region RG6 in the second direction D2 are smaller than those in Reference Example 1 by −22 μm, the ratio of the opposing area is 0.20, and the content of Al in the first and second intermediate electrical conductors 51 and 52 is 0.5 atomic %.

Reference Example 22

In Reference Example 22, the multilayer chip varistor is prepared and tested in the same manner as in Reference Example 1 except that the lengths of the first region RG1 to the sixth region RG6 in the second direction D2 are smaller than those in Reference Example 1 by 73 μm, the ratio of the opposing area is 0.05, and the content of Al in the first and second intermediate electrical conductors 51 and 52 is 0.5 atomic %.

Reference Example 23

In Reference Example 23, the multilayer chip varistor is prepared and tested in the same manner as in Reference Example 1 except that the lengths of the first region RG1 to the eighth region RG8 in the second direction D2 are smaller than those in Reference Example 1 by −22 μm, the ratio of the opposing area is 0.20, the third intermediate electrical conductor 53 is disposed in addition to the first and second intermediate electrical conductors 51 and 52, and the content of Al in the first, second, and third intermediate electrical conductors 51, 52, and 53 is 0 atomic %.

Reference Example 24

In Reference Example 24, the multilayer chip varistor is prepared and tested in the same manner as in Reference Example 1 except that the third intermediate electrical conductor 53 is disposed in addition to the first and second intermediate electrical conductors 51 and 52, and the content of Al in the first, second, and third intermediate electrical conductors 51, 52, and 53 is 0 atomic %.

Reference Example 25

In Reference Example 25, the multilayer chip varistor is prepared and tested in the same manner as in Reference Example 1 except that the lengths of the first region RG1 to the eighth region RG8 in the second direction D2 are smaller than those in Reference Example 1 by 41 μm, the ratio of the opposing area is 0.10, the third intermediate electrical conductor 53 is disposed in addition to the first and second intermediate electrical conductors 51 and 52, and the content of Al in the first, second, and third intermediate electrical conductors 51, 52, and 53 is 0 atomic %.

Reference Example 26

In Reference Example 26, the multilayer chip varistor is prepared and tested in the same manner as in Reference Example 1 except that the lengths of the first region RG1 to the eighth region RG8 in the second direction D2 are smaller than those in Reference Example 1 by −22 μm, the ratio of the opposing area is 0.20, the third intermediate electrical conductor 53 is disposed in addition to the first and second intermediate electrical conductors 51 and 52, and the content of Al in the first, second, and third intermediate electrical conductors 51, 52, and 53 is 0.5 atomic %.

Reference Example 27

In Reference Example 27, the multilayer chip varistor is prepared and tested in the same manner as in Reference Example 1 except that the lengths of the first region RG1 to the eighth region RG8 in the second direction D2 are smaller than those in Reference Example 1 by 73 μm, the ratio of the opposing area is 0.05, the third intermediate electrical conductor 53 is disposed in addition to the first and second intermediate electrical conductors 51 and 52, and the content of Al in the first, second, and third intermediate electrical conductors 51, 52, and 53 is 0.5 atomic %.

FIG. 11 is a table illustrating test results in Reference Example 1 to Reference Example 16 of the multilayer chip varistor according to the present supplementary notes. FIG. 11 illustrates various data of the multilayer chip varistors according to Reference Examples 1 to 16, the results of the ESD tolerance test, the energy resistance test, the leakage current test, and the dynamic resistance test, and the results of the characteristic evaluations based on these test results. FIG. 12 is a table illustrating test results in Reference Example 17 to Reference Example 27 of the multilayer chip varistor according to the present supplementary notes. FIG. 12 illustrates various data of the multilayer chip varistors according to Reference Examples 17 to 27, the results of the ESD tolerance test, the energy resistance test, the leakage current test, and the dynamic resistance test, and the results of the characteristic evaluations based on these test results. In FIGS. 11 and 12, the data of the multilayer chip varistor are the number of intermediate electrical conductors included in the multilayer chip varistor, the length (in the table, expressed as "Relative Length [μm]") in the second direction D2 of the first region RG1 to the sixth region RG6 or the first region RG1 to the eighth region RG8 as compared with Reference Example 1, the ratio of the opposing area, the Al content [atm %] of the internal electrode, and the Al content [atm %] of the intermediate electrical conductor. In FIGS. 11 and 12, when all the test results in the ESD tolerance test, the energy resistance test, the leakage current test, and the dynamic resistance test are judged as "good", the characteristics of the multilayer chip varistor are evaluated as "good". When any one of the test results in the ESD tolerance test, the energy resistance test, the leakage current test, and the dynamic resistance test is judged as "poor", the characteristic of the multilayer chip varistor is evaluated as "poor". In FIGS. 11 and 12, when the characteristics of the multilayer chip varistor are evaluated as "good", "A" is written in the evaluation column, and when the characteristics of the multilayer chip varistor are evaluated as "poor", "B" is written in the evaluation column.

The evaluations in Reference Examples are as follows.

As illustrated in FIG. 11, in Reference Example 1 to Reference Example 5, the multilayer chip varistor EC2 includes the first and second intermediate electrical conductors 51 and 52. The ratio of the opposing areas between the internal electrodes 31, 32, 41, and 42 and the intermediate electrical conductors 51 and 52 to the areas of the intermediate electrical conductors 51 and 52 is 0.17. The content of Al in the intermediate electrical conductors 51 and 52 is equal to or larger than the content of Al in the internal electrodes 31, 32, 41, and 42. In each of Reference Examples 1 to 5, the results of the judgements in the ESD tolerance test, the energy resistance test, the leakage current test, and the dynamic resistance test are judged as "good". In Reference Examples 1 to 5, the characteristic of the multilayer chip varistor EC2 is evaluated as "good".

In Reference Examples 6 to 10, the multilayer chip varistor EC2 includes the first, second, and third intermediate electrical conductors 51, 52, and 53. The ratio of the opposing areas between the internal electrodes 31, 32, 41, and 42 and the intermediate electrical conductors 51, 52, and 53 to the areas of the intermediate electrical conductors 51, 52, and 53 is 0.17. The content of Al in the intermediate electrical conductors 51, 52, and 53 is equal to or larger than the content of Al in the internal electrodes 31, 32, 41, and 42. In each of Reference Examples 6 to 10, the results of the judgements in the ESD tolerance test, the energy resistance test, the leakage current test, and the dynamic resistance test are judged as "good". In Reference Examples 6 to 10, the characteristic of the multilayer chip varistor EC2 is evaluated as "good".

In Reference Example 11, the multilayer chip varistor EC2 includes the first and second intermediate electrical conductors 51 and 52. The ratio of the opposing areas between the internal electrodes 31, 32, 41, and 42 and the intermediate electrical conductors 51 and 52 to the areas of the intermediate electrical conductors 51 and 52 is 0.10. The content of Al in the intermediate electrical conductors 51 and 52 is equal to or larger than the content of Al in the internal electrodes 31, 32, 41, and 42. In Reference Example 11, the results of the judgements in the ESD tolerance test, the energy resistance test, the leakage current test, and the dynamic resistance test are judged as "good". In Reference Example 11, the characteristic of the multilayer chip varistor EC2 is evaluated as "good".

In Reference Example 12, the multilayer chip varistor EC2 includes the first, second, and third intermediate electrical conductors 51, 52, and 53. The ratio of the opposing areas between the internal electrodes 31, 32, 41, and 42 and the intermediate electrical conductors 51, 52, and 53 to the areas of the intermediate electrical conductors 51, 52, and 53 is 0.10. The content of Al in the intermediate electrical conductors 51, 52, and 53 is equal to or larger than the content of Al in the internal electrodes 31, 32, 41, and 42. In Reference Example 12, the results of the judgements in the ESD tolerance test, the energy resistance test, the leakage current test, and the dynamic resistance test are judged as "good". In Reference Example 12, the characteristic of the multilayer chip varistor EC2 is evaluated as "good".

In Reference Example 13 and Reference Example 14, the multilayer chip varistor EC2 includes the first and second intermediate electrical conductors 51 and 52. The ratio of the opposing areas between the internal electrodes 31, 32, 41, and 42 and the intermediate electrical conductors 51 and 52 to the areas of the intermediate electrical conductors 51 and 52 is 0.17. In a case where the content of Al in the internal electrodes 31, 32, 41, and 42 is larger than 0, the content of Al in the intermediate electrical conductors 51 and 52 is equal to or larger than the content of Al in the internal electrodes 31, 32, 41, and 42. In each of Reference Example 13 and Reference Example 14, the results of the judgements in the ESD tolerance test, the energy resistance test, the leakage current test, and the dynamic resistance test are judged as "good". In Reference Example 13 and Reference Example 14, the characteristic of the multilayer chip varistor EC2 is evaluated as "good".

In Reference Example 15 and Reference Example 16, the multilayer chip varistor EC2 includes the first, second, and third intermediate electrical conductors 51, 52, and 53. The ratio of the opposing areas between the internal electrodes 31, 32, 41, and 42 and the intermediate electrical conductors 51, 52, and 53 to the areas of the intermediate electrical conductors 51, 52, and 53 is 0.17. In a case where the content of Al in the internal electrodes 31, 32, 41, and 42 is larger than 0, the content of Al in the intermediate electrical conductors 51 and 52 is equal to or larger than the content of Al in the internal electrodes 31, 32, 41, and 42. In each of Reference Example 15 and Reference Example 16, the results of the judgements in the ESD tolerance test, the energy resistance test, the leakage current test, and the dynamic resistance test are judged as "good". In Reference Example 15 and Reference Example 16, the characteristic of the multilayer chip varistor EC2 is evaluated as "good".

In Reference Example 17, only the first intermediate electrical conductor 51 is disposed between the first and third internal electrodes 31 and 32 and the second and fourth internal electrodes 41 and 42. In Reference Example 17, the result of the dynamic resistance test is judged as "poor", and the characteristic of the multilayer chip varistor is evaluated as "poor".

In Reference Examples 18 to 20, the multilayer chip varistor includes the first and second intermediate electrical conductors 51 and 52. The content of Al in the intermediate electrical conductors 51 and 52 is 0 atomic %. In each of Reference Example 18 to Reference Example 20, the results of the ESD tolerance test, the energy resistance test, and the dynamic resistance test are judged as "poor". In Reference Examples 18 to 20, the characteristic of the multilayer chip varistor is evaluated as "poor".

In Reference Example 21, the multilayer chip varistor includes the first and second intermediate electrical conductors 51 and 52. The ratio of the opposing area is larger than 1.7. In Reference Example 21, the results of the ESD tolerance test and the energy resistance test are judged as "poor". In Reference Example 21, the characteristic of the multilayer chip varistor is evaluated as "poor".

In Reference Example 22, the multilayer chip varistor includes the first and second intermediate electrical conductors 51 and 52. The ratio of the opposing area is smaller than 1.0. In Reference Example 21, the results of the ESD tolerance test, the energy resistance test, and the dynamic resistance test are judged as "poor". In Reference Example 21, the characteristic of the multilayer chip varistor is evaluated as "poor".

In Reference Examples 23 to 25, the multilayer chip varistor includes the first, second, and third intermediate electrical conductors 51, 52, and 53. The content of Al in the intermediate electrical conductors 51, 52, and 53 is 0 atomic %. In each of Reference Example 23 to Reference Example 25, the results of the ESD tolerance test, the energy resistance test, and the dynamic resistance test are judged as "poor". In Reference Examples 23 to 25, the characteristic of the multilayer chip varistor is evaluated as "poor".

In Reference Example 26, the multilayer chip varistor includes the first, second, and third intermediate electrical conductors 51, 52, and 53. The ratio of the opposing area is larger than 1.7. In Reference Example 26, the results of the ESD tolerance test and the energy resistance test are judged as "poor". In Reference Example 26, the characteristic of the multilayer chip varistor is evaluated as "poor".

In Reference Example 27, the multilayer chip varistor includes the first, second, and third intermediate electrical conductors 51, 52, and 53. The ratio of the opposing area is smaller than 1.0. In Reference Example 27, the results of the ESD tolerance test, the energy resistance test, and the dynamic resistance test are judged as "poor". In Reference Example 27, the characteristic of the multilayer chip varistor is evaluated as "poor".

Although the present supplementary notes and the reference examples have been described above, the contents of the present supplementary notes are not necessarily limited to the above-described aspects and reference examples related to the above-described supplementary notes, and various modifications can be made without departing from the gist thereof.

In the present supplementary notes, the first intermediate electrical conductor 51 may not include the second electrically conductive material. In the configuration in which the first intermediate electrical conductor 51 includes the second electrically conductive material, as described above, the element body 1 includes a region in which the second electrically conductive material included in the first intermediate electrical conductor 51 is diffused between the first, second, third, and fourth internal electrodes 31, 41, 32, and 42 and the first intermediate electrical conductor 51. The region in which the second electrically conductive material is diffused has a lower electrical resistance than the region in which the second electrically conductive material is not diffused, and the multilayer chip varistor EC2 has the improved ESD tolerance.

In the present supplementary notes and the reference examples, the multilayer chip varistor has been described as an example, but the applicable component is not limited to the above-described multilayer chip varistor. A component applicable to components other than the above-described multilayer chip varistor is, for example, a chip type electronic component including a varistor.

Although the embodiment of the present invention has been described above, the present invention is not necessarily limited to the embodiment, and the embodiment can be variously changed without departing from the scope of the invention.

What is claimed is:

1. A multilayer chip varistor comprising:

an element body exhibiting varistor characteristics;

a first external electrode and a second external electrode disposed at both ends of the element body; and a first electrical conductor group and a second electrical conductor group disposed in the element body, wherein the first electrical conductor group includes:

a first internal electrode including a first electrically conductive material, the first internal electrode being exposed at one end of the ends and connected to the first external electrode; and a first intermediate electrical conductor opposed to the first internal electrode and not connected to the first and second external electrodes, the second electrical conductor group includes:

a second internal electrode including the first electrically conductive material, the second internal electrode being exposed at another end of the ends and connected to the second external electrode; and a second intermediate electrical conductor opposed to the second internal electrode and not connected to the first and second external electrodes, the first and second electrical conductor groups are disposed in the element body such that the first intermediate electrical conductor and the second intermediate electrical conductor are opposed to each other in a direction where the first internal electrode and the first intermediate electrical conductor are opposed to each other and in a direction where the second internal electrode and the second intermediate electrical conductor are opposed to each other, at least one of the first and second intermediate electrical conductors includes a second electrically conductive material different from the first electrically conductive material, and the element body includes a low electrical resistance region between the first and second internal electrodes, and the second electrically conductive material included in the at least one of the first and second intermediate electrical conductors is diffused in the low electrical resistance region.

2. The multilayer chip varistor according to claim 1, further comprising:

a first internal electrical conductor disposed in the same layer as at least one intermediate electrical conductor of the first and second intermediate electrical conductors, the first internal electrical conductor being separated from the at least one intermediate electrical conductor, exposed at the one end, and connected to the first external electrode; and a second internal electrical conductor disposed in the same layer as at least one intermediate electrical conductor of the first and second intermediate electrical conductors, the second internal electrical conductor being separated from the at least one intermediate electrical conductor, exposed at the other end, and connected to the second external electrode.

3. The multilayer chip varistor according to claim 1, wherein the first and second internal electrodes further include the second electrically conductive material.

4. The multilayer chip varistor according to claim 3, wherein a content of the second electrically conductive material in the at least one intermediate electrical conductor of the first and second intermediate electrical conductors is equal to or larger than a content of the second electrically conductive material in each of the first and second internal electrodes.

5. The multilayer chip varistor according to claim 1, wherein the first and second intermediate electrical conductors include the second electrically conductive material.

6. The multilayer chip varistor according to claim 1, wherein the first electrically conductive material includes palladium, and wherein the second electrically conductive material includes aluminum.

* * * * *